US008159110B2

(12) United States Patent
Tsuyoshi et al.

(10) Patent No.: US 8,159,110 B2
(45) Date of Patent: Apr. 17, 2012

(54) FLUID ACTUATOR, AND HEAT GENERATING DEVICE AND ANALYSIS DEVICE USING THE SAME

(75) Inventors: Hirotaka Tsuyoshi, Soraku-gun (JP); Ryusuke Tsuyoshi, legal representative, Katano (JP); Susumu Suguyama, Kusatsu (JP)

(73) Assignee: Kyocera Corporation, Kyoto (JP)

( * ) Notice: Subject to any disclaimer, the term of this patent is extended or adjusted under 35 U.S.C. 154(b) by 965 days.

(21) Appl. No.: 12/096,018

(22) PCT Filed: Dec. 8, 2006

(86) PCT No.: PCT/JP2006/324596

§ 371 (c)(1), (2), (4) Date: Jun. 3, 2008

(87) PCT Pub. No.: WO2007/066777

PCT Pub. Date: Jun. 14, 2007

(65) Prior Publication Data

US 2009/0314062 A1 Dec. 24, 2009

(30) Foreign Application Priority Data

Dec. 9, 2005 (JP) ..... 2005-356839
Dec. 9, 2005 (JP) ..... 2005-356841
Dec. 9, 2005 (JP) ..... 2005-356843

(51) Int. Cl.
*H01L 41/047* (2006.01)

(52) U.S. Cl. ..... 310/313 R; 310/313 A; 310/313 B; 310/313 D

(58) Field of Classification Search ..... 310/313 A, 310/313 B, 313 R, 313 D
See application file for complete search history.

(56) References Cited

U.S. PATENT DOCUMENTS 4,768,256 A * 9/1988 Motoda ..... 15/250.001
5,668,303 A * 9/1997 Giesler et al. ..... 73/24.06
6,010,316 A 1/2000 Haller et al.
6,720,710 B1 * 4/2004 Wenzel et al. ..... 310/328
6,750,521 B1 * 6/2004 Chilcott et al. ..... 257/414
6,781,478 B2 * 8/2004 Takamine et al. ..... 333/133

(Continued)

FOREIGN PATENT DOCUMENTS

JP 03-116782 12/1991

(Continued)

OTHER PUBLICATIONS

Daniel J. Laser et al., "Silicon Electroosmotic Micropumps for Integrated Circuit Thermal Management", IEEE Transducers, pp. 151-154, 2003.

(Continued)

*Primary Examiner* — Walter Benson
*Assistant Examiner* — Bryan Gordon
(74) *Attorney, Agent, or Firm* — DLA Piper LLP (US)

(57) ABSTRACT

A fluid actuator includes a piezoelectric body (31), a fluid channel (2) having the piezoelectric body (31) on a part of the inner wall thereof and enabling a fluid to move inside, and a surface acoustic wave generation portion (101) for driving the fluid in the fluid channel by surface acoustic waves generated from a interdigital electrode formed on the surface of the piezoelectric body (31) facing the fluid channel (2). The surface acoustic wave generation portion (101) is arranged at the position offset from the center of the fluid channel (2). The fluid actuator can perform drive with a low voltage and drives the fluid in a narrow fluid channel in a single direction.

22 Claims, 22 Drawing Sheets

U.S. PATENT DOCUMENTS

| | | | | |
|---|---|---|---|---|
| 2003/0109077 | A1* | 6/2003 | Kim et al. | 438/106 |
| 2006/0291164 | A1* | 12/2006 | Myers et al. | 361/699 |
| 2007/0065308 | A1* | 3/2007 | Yamamoto et al. | 417/413.1 |

FOREIGN PATENT DOCUMENTS

| | | | |
|---|---|---|---|
| JP | 07-226641 | | 8/1995 |
| JP | 11-348266 | | 12/1999 |
| JP | 2001-257562 | | 9/2001 |
| JP | 2001257562 | A | 9/2001 |
| JP | 2002-178507 | | 6/2002 |
| JP | 2004-017385 | | 1/2004 |
| JP | 2004-190537 | | 7/2004 |
| JP | 2005-257407 | | 9/2005 |
| JP | 2006-090155 | | 4/2006 |
| WO | WO 2005/012729 | A1 | 2/2005 |

OTHER PUBLICATIONS

R. M. Moroney et al., "Microtransport Induced by Ultrasonic Lamb Waves", Appl. Phys. Lett., 59(7), pp. 774-776, Aug. 12, 1991.

Extended European search report dated May 16, 2011 for corresponding European application 06834351.6.

English translation of Japanese office action dated Oct. 27, 2011 for corresponding Japanese application 2007549199.

* cited by examiner

FIG. 3 ( a )
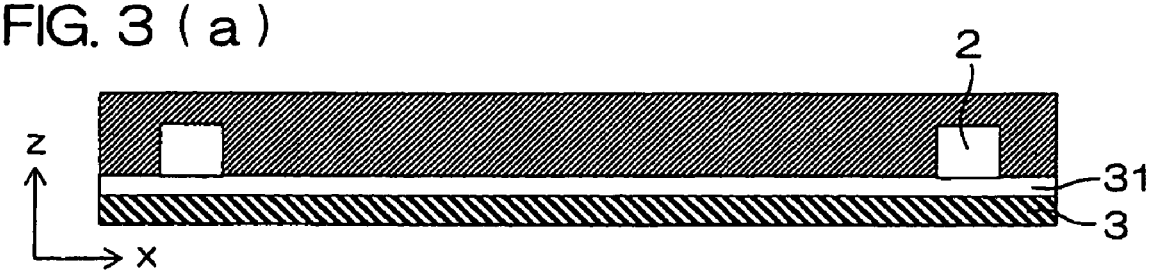
FIG. 3 ( b )
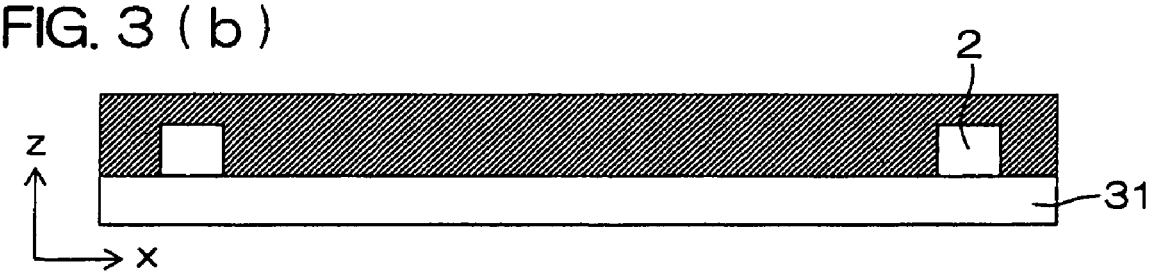

FIG. 4 ( a )
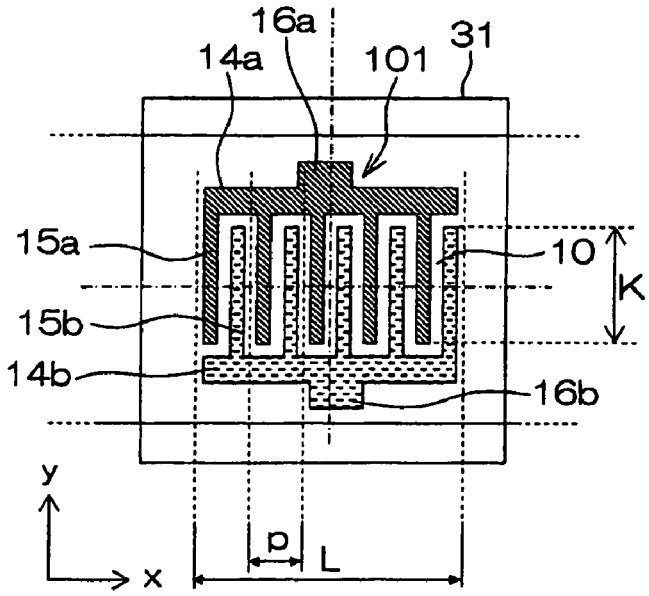
FIG. 4 ( b )
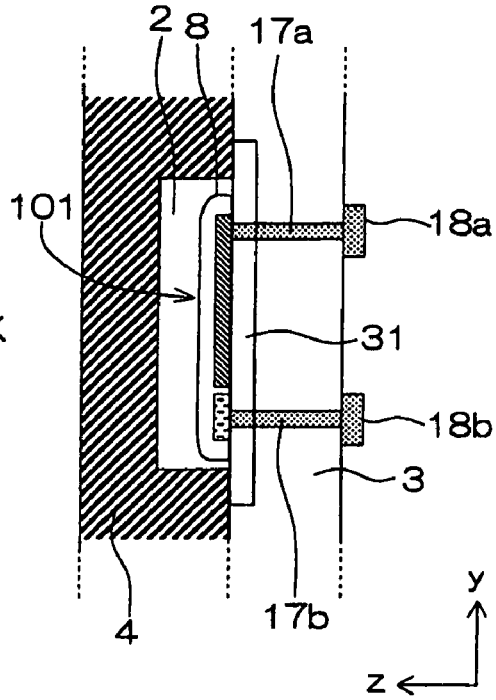
FIG. 4 ( c )
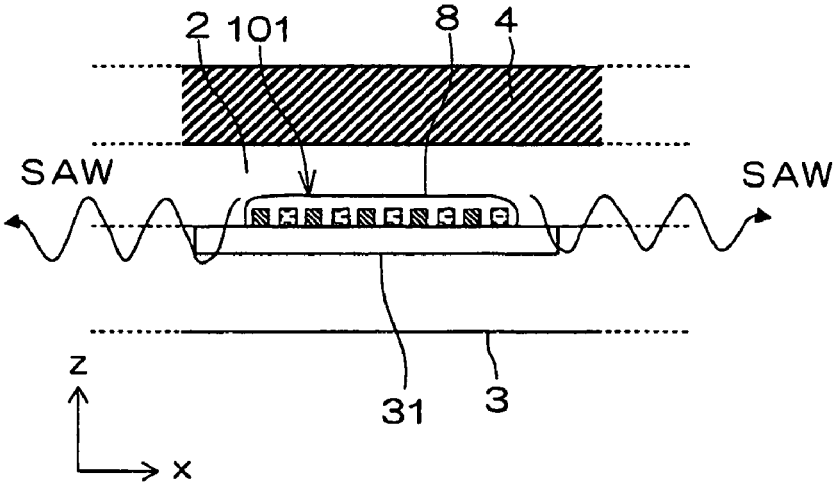
FIG. 5
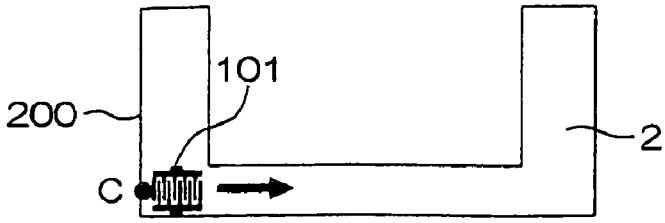

FIG. 8 ( a )
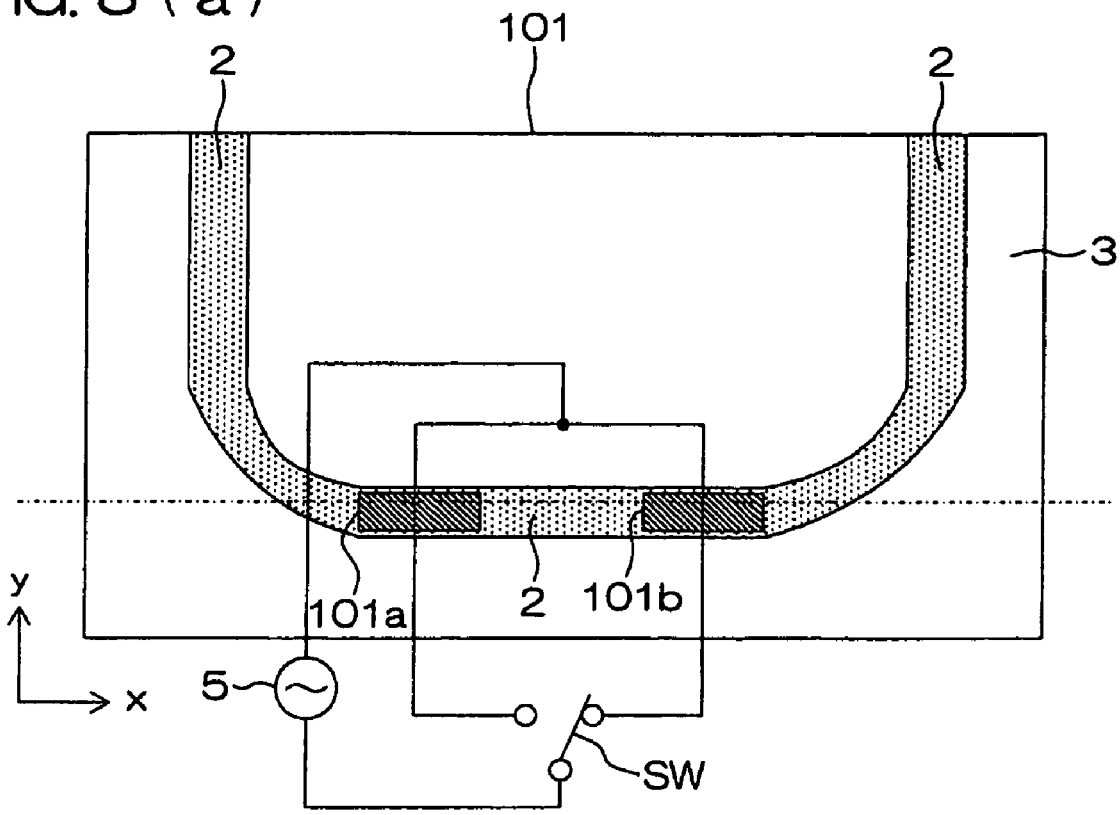
FIG. 8 ( b )
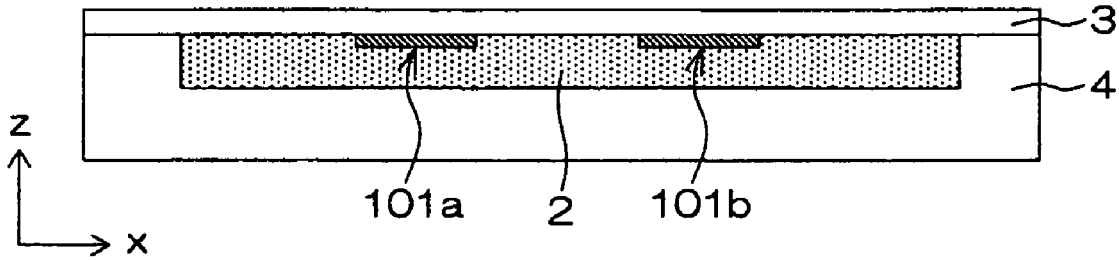

FIG. 9 ( a )
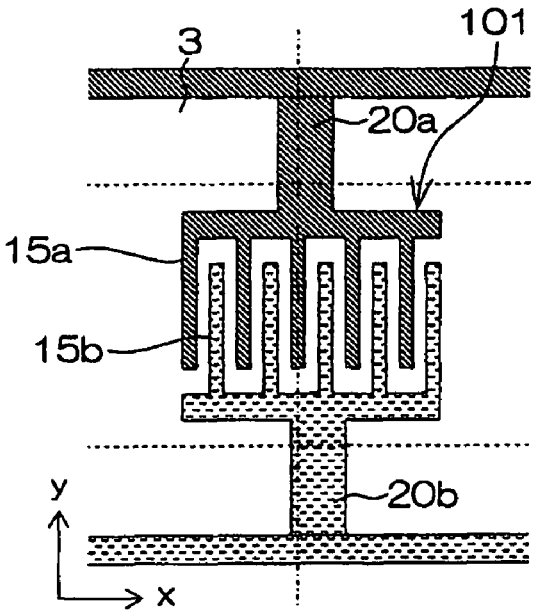
FIG. 9 ( b )
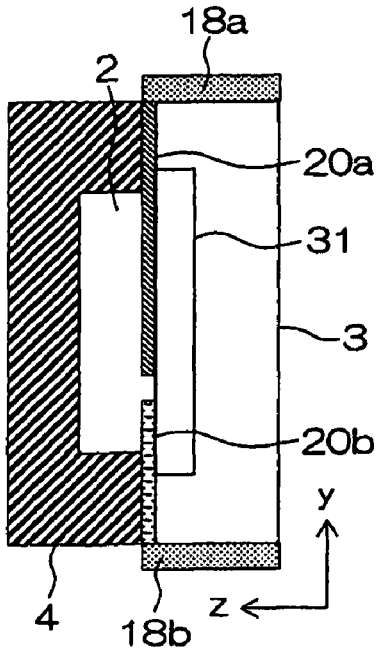

FIG. 10 ( a )
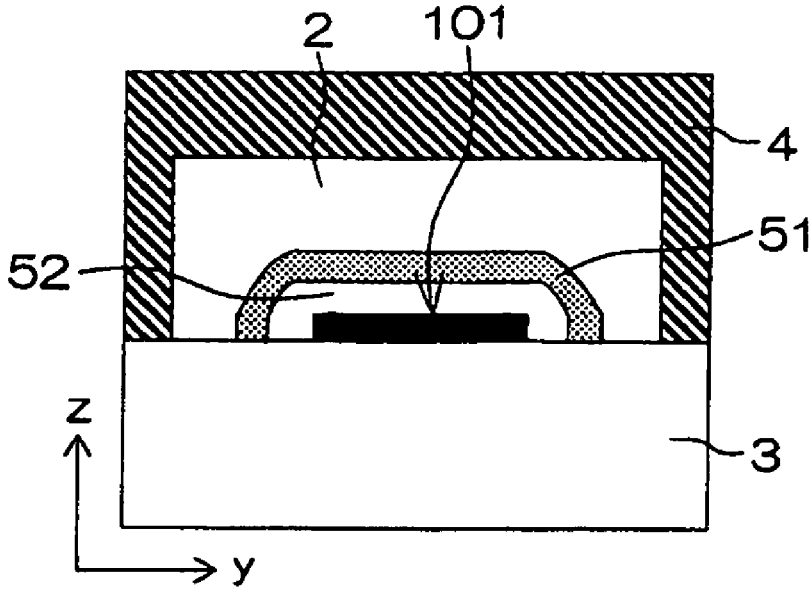
FIG. 10 ( b )
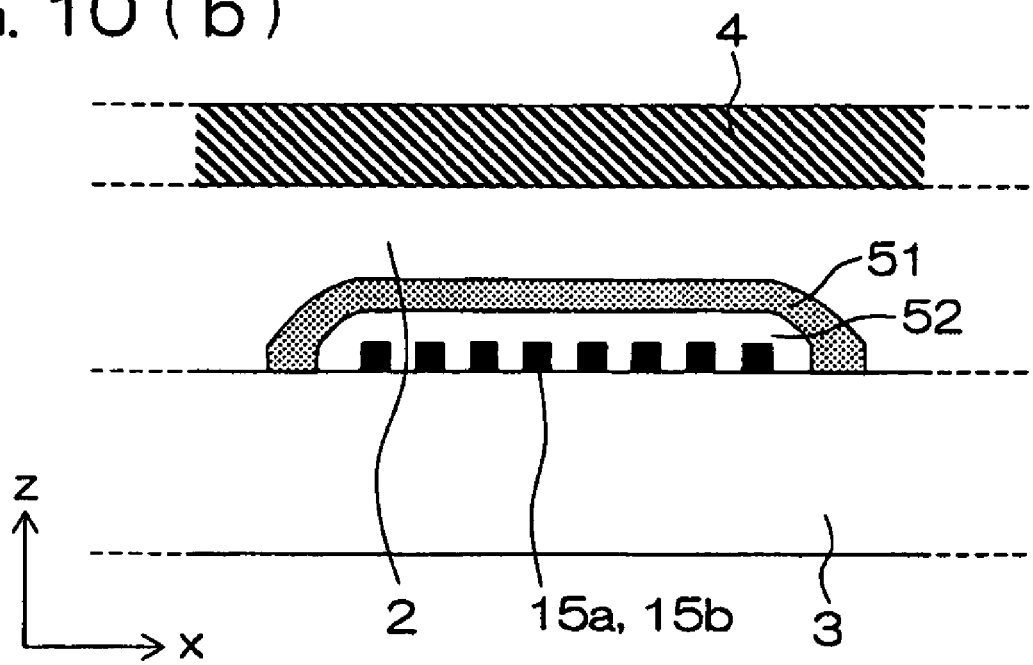

FIG. 20 ( a )
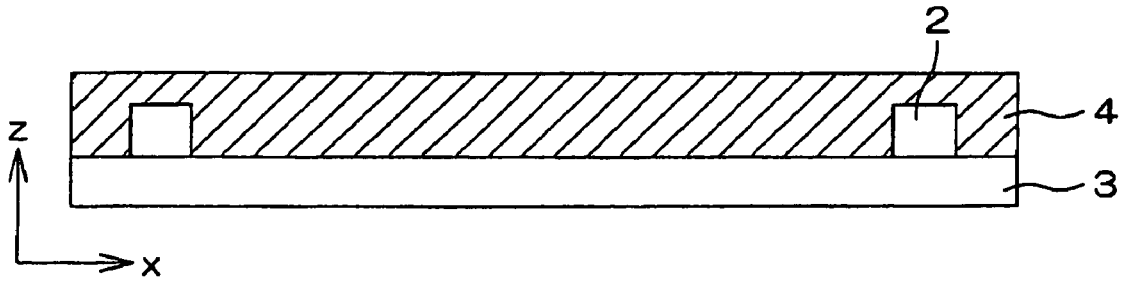
FIG. 20 ( b )
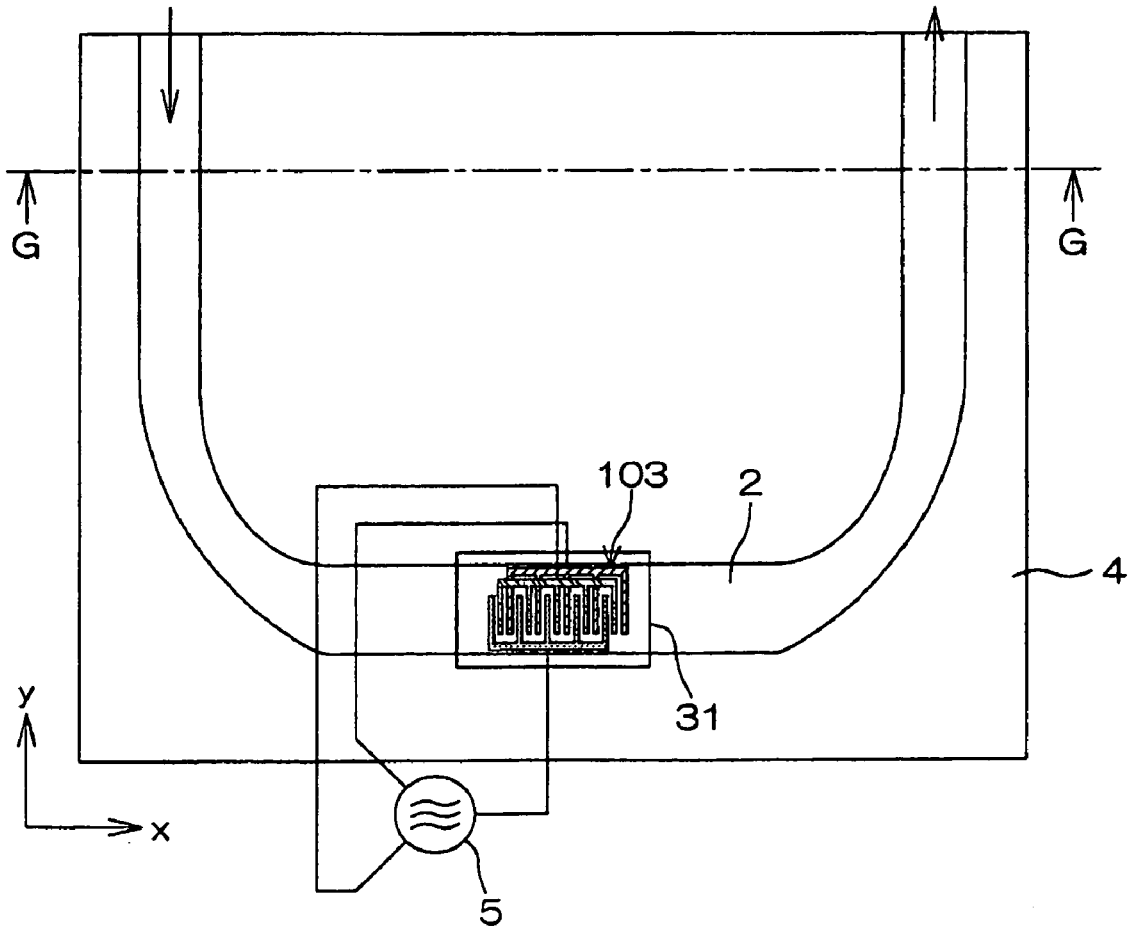

SAW

FIG. 24
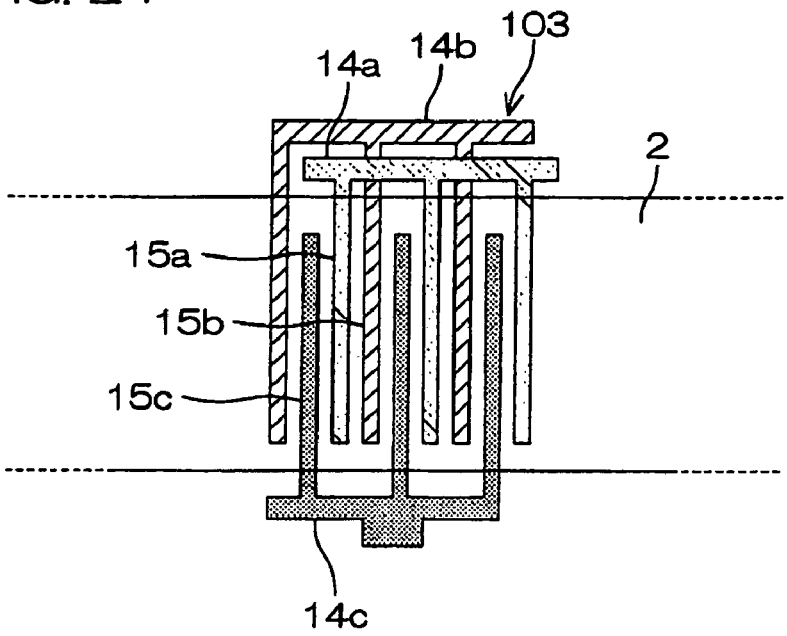
FIG. 25 ( a )
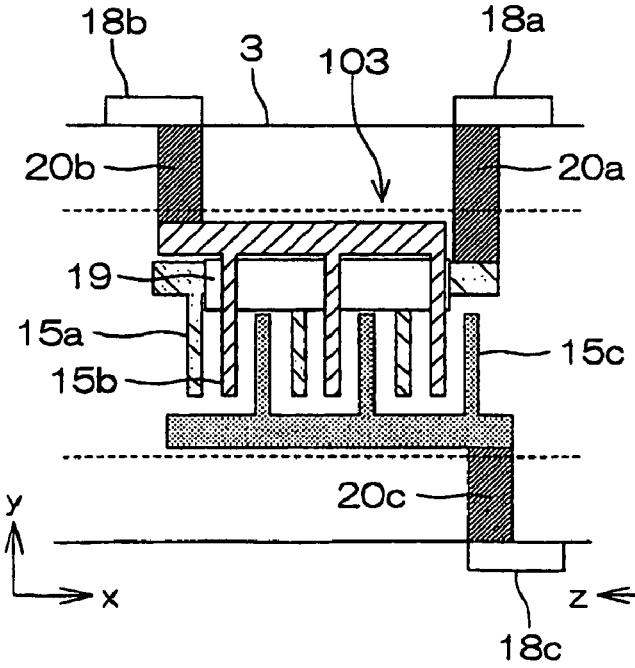
FIG. 25 ( b )
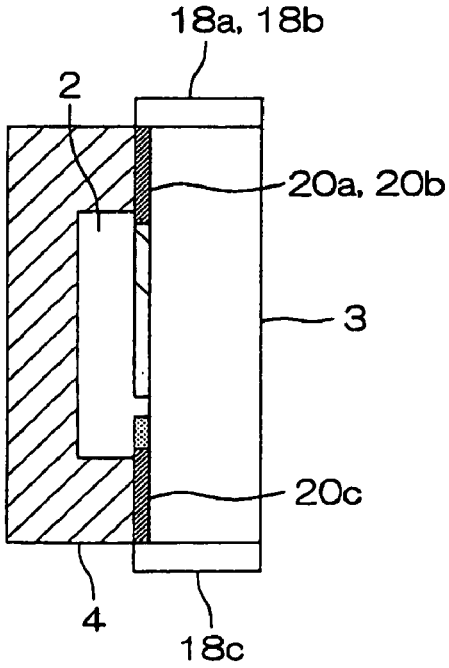

FIG. 26 ( a )
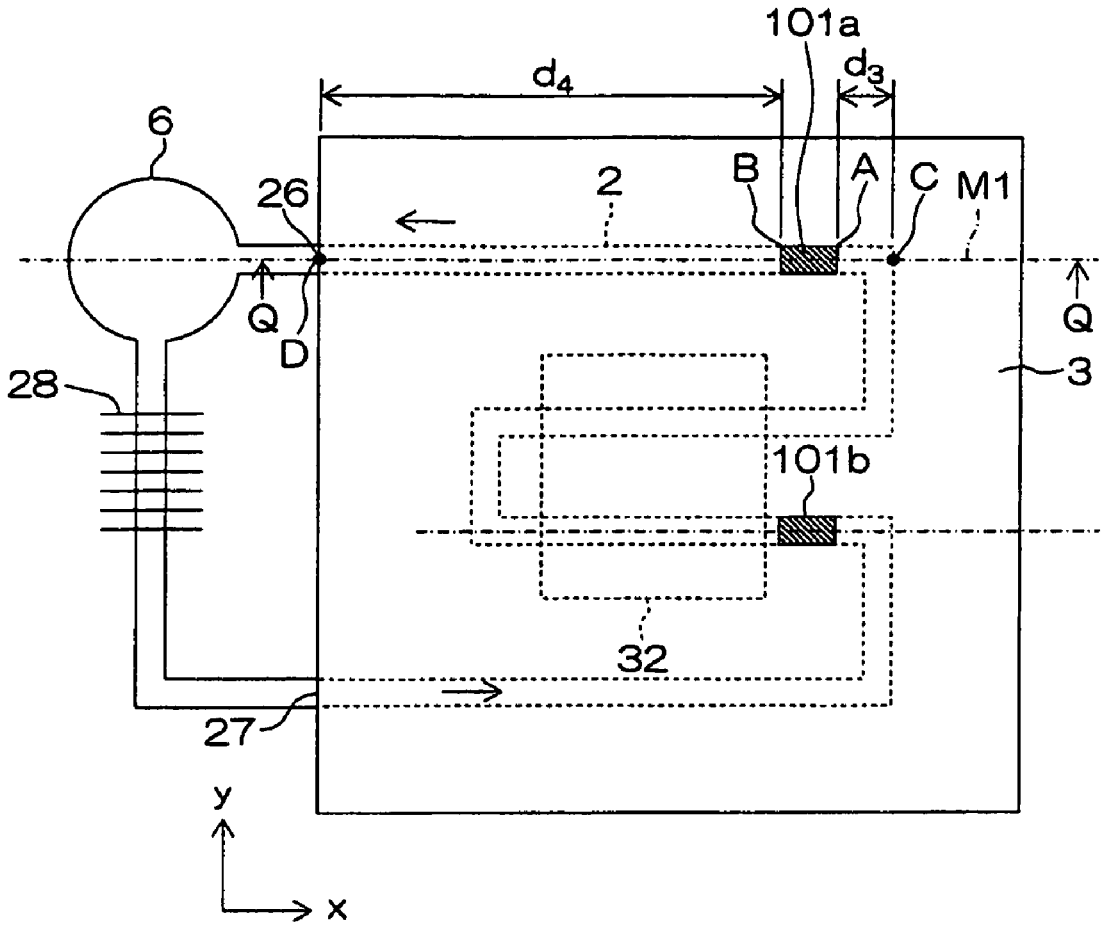
FIG. 26 ( b )
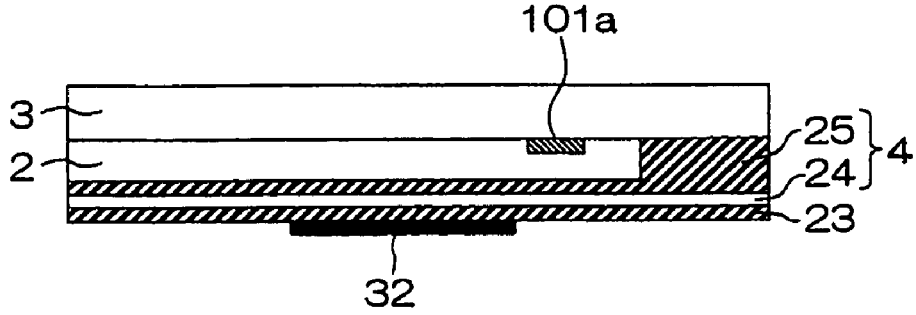

FIG. 27 ( a )
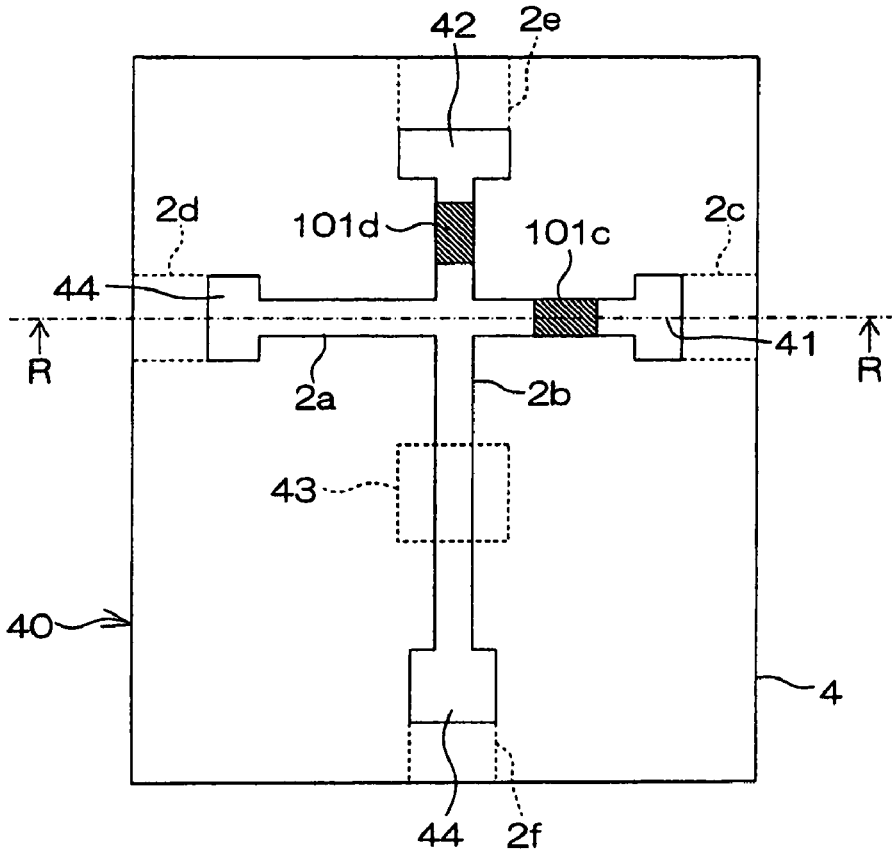
FIG. 27 ( b )
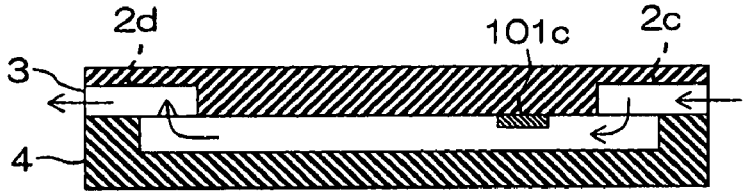
FIG. 28 ( a )
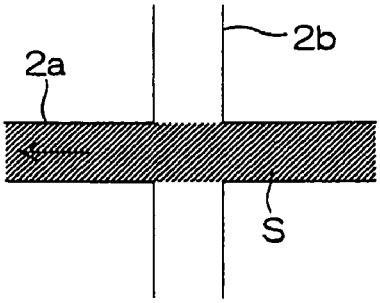
FIG. 28 ( b )
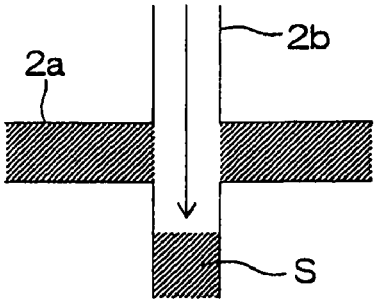

FIG. 29 ( a )
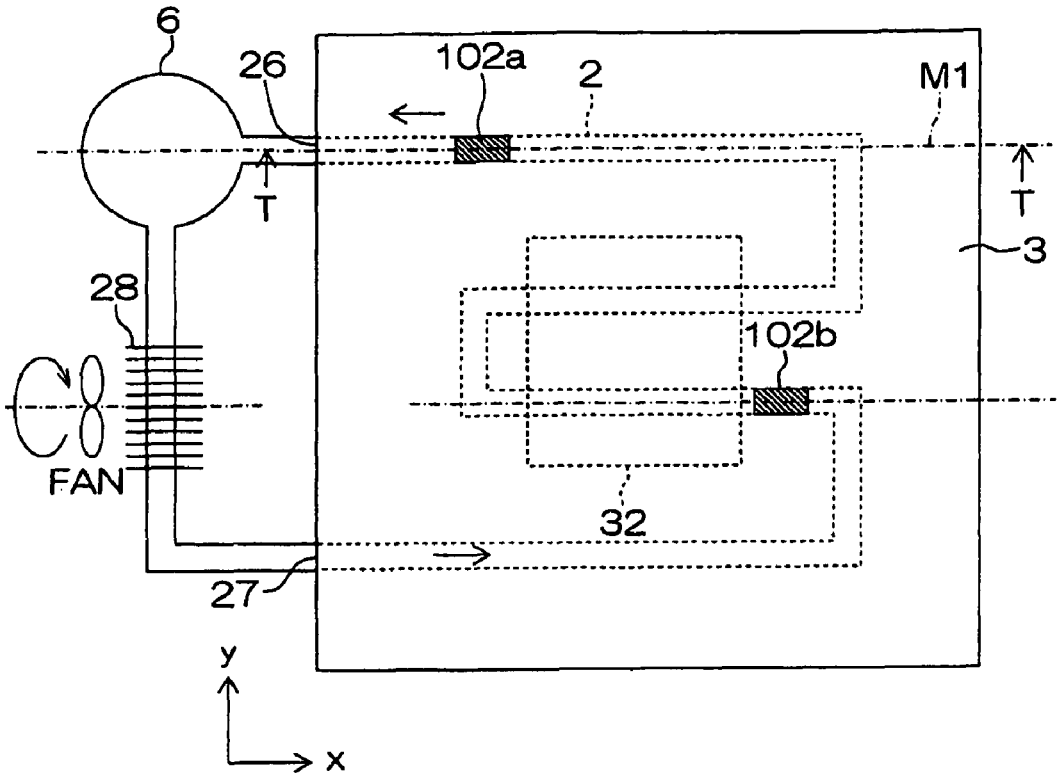
FIG. 29 ( b )
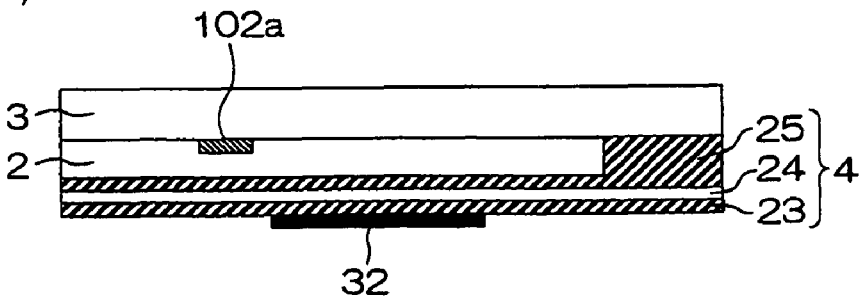

FLUID ACTUATOR, AND HEAT GENERATING DEVICE AND ANALYSIS DEVICE USING THE SAME

TECHNICAL FIELD

The present invention relates to a fluid actuator for causing a constant flow or a circulating flow in a fluid with surface acoustic waves (SAW). The present invention also relates to a heat generating device and an analysis device using the fluid actuator.

BACKGROUND ART

The speed of a microprocessor unit (MPU) has recently been remarkably increased. At present, the working frequency reaches not less than several GHz, and is in the process of further speed increase. Speed increase of the MPU is realized by increasing the integration density, and hence the heat generation density is inevitably increased. In the MPU having the maximum speed at present, the total heat generation amount reaches not less than 100 W and the heat generation density reaches not less than 400 W/mm$^2$, and the heat generation amount is also continuously increased due to further speed increase.

In some cases, a fan or a water cooler is provided on the upper surface of the MPU package in order to cool the MPU. However, a heat generating section of the MPU is a circuit section formed on a silicon substrate. Cooling is performed through the package or the like, and hence the cooling efficiency is disadvantageously low.

Therefore, a structure obtained by forming a fluid channel on the silicon substrate of the MPU for circulating a fluid in the fluid channel is proposed. Cooling is enabled extremely in the vicinity of the semiconductor substrate generating heat, thereby coping with increase in heat generation following speed increase of the MPU. However, this water cooling system for the MPU employs an electroosmotic flow pump as a pump. Therefore, fluid channel resistance is increased in the narrow fluid channel formed on the silicon substrate of the MPU, and hence a high driving voltage of about 400 V is disadvantageously required.

While an electroosmotic flow is employed for flowing a solvent containing an analytical sample and electrophoresis or dielectrophoresis is employed for migrating sample particles in the solvent also in a microanalysis system (μTAS), this system directly applies an electric field to the solution, and hence the same is unsuitable for a sample denatured upon application of the electric field.

In consideration of the aforementioned conditions, it is understood that a fluid actuator driving a fluid with surface acoustic wave vibration is preferable. Patent Document 1, Non-Patent Document 1 and Patent Document 2 disclose fluid actuators employing surface acoustic waves.

Patent Document 1 discloses a micropump obtained by arranging surface wave generating means provided with interdigital (comb-shaped) electrodes on a piezoelectric element constituting a part of a fluid channel.

Non-Patent Document 1 discloses a fluid actuator having an interdigital electrode provided on a piezoelectric thin film for driving a fluid on a substrate by applying an AC voltage to the interdigital electrode to induce Lamb waves.

Patent Document 2 discloses an ink jet head provided with two piezoelectric substrates having a thickness generally equivalent to the wavelength of surface acoustic waves superposed with each other through a rib for forming a nozzle, and UDTs (unidirectional comb-shaped interdigital electrodes) respectively arranged on the surfaces of the piezoelectric substrates opposite to the nozzle for sequentially inputting one pulse waveform into the UDTs in an out-of-phase manner to drive the same, thereby generating back surface waves of surface acoustic waves on a wall surface forming the nozzle of the piezoelectric body, so that convex strain on the nozzle wall surface moves toward the forward end of the nozzle due to the back surface waves and the fluid in the nozzle is dragged by this convex strain to move toward the forward end and is ejected from the forward end of the nozzle as droplets.

Patent Document 1: Japanese Unexamined Utility Model Publication No. 03-116782

Patent Document 2: Japanese Unexampled Patent Publication No. 2002-178507

Non-Patent Document 1: R. M. Moroney et. al., "Microtransport induced by ultrasonic Lamb waves", Appl. Phys. Lett. 59(7), E-E774-776, 1991

DISCLOSURE OF THE INVENTION

Problems to be Solved by the Invention

However, the conventional fluid actuators have the following problems:

The micropump employing surface acoustic waves according to Patent Document 1 employs an electrode having a constant pitch constituted by meshing a pair of interdigital electrodes with each other, and hence it is difficult to unidirectionally drive a fluid even when generating surface acoustic waves from this electrode;

The fluid actuator employing Lamb waves according to Non-Patent Document 1 is formed on a thin film having a thickness of several μm, and hence the same has low strength and cannot generate a high pressure.

The fluid actuator according to Patent Document 2 employing waves (back surface waves) of the surface acoustic waves reaching the back surfaces of the substrates has a small amplitude of about 1/10 of the amplitude on the substrate surfaces, and cannot efficiently drive the fluid. While this document describes that the height of the rib, i.e., the height of the fluid channel, is desirably generally identical to the amplitude of the back surface waves, the amplitude of the back surface waves is not more than about 1 μm if a voltage of about several 10 volts is merely applied to the UDT electrodes, and it is technically difficult to prepare the nozzle with the rib having this height.

An object of the present invention is to provide a fluid actuator capable of driving with a high output at a relatively low voltage and allowing downsizing and weight reduction.

Another object of the present invention is to provide a heat generating device and an analysis device integrated with the fluid actuator to require no external pump, which can be simultaneously produced through a batch process.

Solutions to the Problems

The fluid actuator according to the present invention is a fluid actuator including a piezoelectric body, a fluid channel having the piezoelectric body on a part of the inner wall thereof and capable of moving a fluid therein, and a surface acoustic wave generating portion driving the fluid in the fluid channel with surface acoustic waves generated from an interdigital electrode formed on a surface of the piezoelectric body facing the fluid channel, and the surface acoustic wave generating portion moves the fluid in a single direction by applying stronger driving force to the fluid in the fluid channel located on one side to which the surface acoustic waves propagate than to the fluid in the fluid channel located on the other side.

According to the fluid actuator having this structure, the surface acoustic waves (SAW) are generated on the surface of the piezoelectric body when an AC voltage is applied to the interdigital electrode of the surface acoustic wave generating portion, to bidirectionally propagate from the interdigital electrode in the fluid channel. The fluid actuator is so formed that surface acoustic waves propagating in the single direction included in the bidirectionally propagating surface acoustic waves supply strong fluid driving force to the fluid present in this direction. Therefore, the fluid actuator can drive the fluid in the fluid channel in the single direction with the surface acoustic waves excited in this manner.

According to one aspect of the present invention, assuming that C and D denote points where a straight line extended along bath propagation directions of surface acoustic waves generated from a surface acoustic wave generating portion 101 collides with the wall surfaces of a fluid channel 2 or ports of the fluid channel respectively as specifically shown in FIG. 1, the surface acoustic wave generating portion is arranged on a position shifted from the central position of the fluid channel sandwiched between the points C and D in either propagation direction of the surface acoustic waves.

In the surface acoustic waves horizontally uniformly excited from the surface acoustic wave generating portion 101, therefore, waves propagating in one direction (direction D, for example) exhibit driving force for driving the fluid in the single direction and waves propagating in the other direction (direction C) exhibit driving force driving the fluid in the other direction. However, an area S2 of the region where the driving force is transmitted to the fluid on the one side is greater than an area S1 of the region where the driving force is transmitted to the fluid on the other side in plan view, and hence the driving force to the fluid on the one side surpasses that to the other side, whereby the fluid flows in the one direction (direction D) as a whole, as shown in the FIG. 1.

Therefore, the fluid actuator can drive the fluid in the single direction with a low driving voltage and a simple electrode structure.

The expression "the surface acoustic wave generating portion is arranged on a position shifted from the central position between the points C and D in either propagation direction of the surface acoustic waves" is equivalent to that a distance $d_1$ between one end A of the surface acoustic wave generating portion 101 and the wall surface C of the fluid channel and a distance $d_2$ between the other end B of the surface acoustic wave generating portion and the wall surface D of the fluid channel are in such a relation that one (the distance $d_2$, for example) is larger and the other (the distance $d_1$) is smaller.

If the smaller distance is not more than 20 mm, it is sufficient to cause a flow in a single direction in a general microanalysis system (μTAS) device.

If the wall surface of the fluid channel closer to the surface acoustic wave generating portion is a plane generally orthogonal to the propagation directions of the surface acoustic waves, the surface acoustic waves directed from the point A to the point C are partially reflected at the point C to progress in the same direction as the surface acoustic waves directed from the point B to the point D in a superposed manner, whereby the fluid also strongly flows in the direction from the point B toward the point D.

According to another aspect of the present invention, the surface acoustic wave generating portion of the fluid actuator generates surface acoustic waves having directivity in the single direction. According to this structure, surface acoustic waves having directivity in the single direction, i.e., surface acoustic waves more strongly propagating toward the single direction are generated on the surface of the piezoelectric body when an AC voltage is applied to the interdigital electrode of the surface acoustic wave generating portion, to propagate in the single direction along the substrate. The fluid actuator can drive the fluid in the fluid channel in the single direction with the surface acoustic waves excited in this manner.

Preferably, the surface acoustic wave generating portion includes between adjacent electrode fingers of the interdigital electrode a floating electrode arranged parallelly to these electrode fingers on a position offset from the center between these electrode fingers toward the direction of either electrode finger, in order to generate the surface acoustic waves having directivity in the single direction. According to this structure, the floating electrode asymmetrically reflects the surface acoustic waves, whereby directivity appears in the propagation direction of the surface acoustic waves. The surface acoustic waves having directivity in the single direction can be generated by applying an AC voltage to the interdigital electrode, whereby the fluid actuator can drive the fluid in the channel in the single direction.

The surface acoustic wave generating portion may include a reflector electrode arranged adjacently to one side of the interdigital electrode for reflecting the surface acoustic waves generated in and propagating from the interdigital electrode in the opposite direction. According to this structure, the surface acoustic waves propagating in the one direction included in the surface acoustic waves horizontally propagating from the interdigital electrode with the same strength are reflected by the reflector electrode to propagate in superposition with the surface acoustic waves propagating in the other direction, whereby the surface acoustic waves can be propagated in the first direction as a whole, allowing the fluid in the channel to be driven in a predetermined direction.

According to the fluid actuator according to still another aspect of the present invention, the surface acoustic wave generating portion has at least three types of interdigital electrodes respectively provided with constant-pitch electrode fingers arranged in mesh with one another, and AC voltages sequentially out of phase with one another are applied to the at least three types of interdigital electrodes, thereby generating the surface acoustic waves having directivity in the single direction. According to the fluid actuator having this structure, the surface acoustic waves having directivity in the single direction are generated on the surface of the piezoelectric body when the AC voltages sequentially out of phase with one another are applied to the at least three types of interdigital electrodes of the surface acoustic wave generating portion, to propagate in the single direction along the substrate. The fluid actuator can drive the fluid in the fluid channel in the single direction with the surface acoustic waves excited in this manner. Further, the fluid actuator can also oppositely drive the liquid in the channel, by controlling the order of changing the phases of the three-phase AC voltages applied to the interdigital electrodes of the surface acoustic wave generating portion.

In the fluid actuator according to a further aspect of the present invention, the surface acoustic wave generating portion has two types of interdigital electrodes respectively provided with constant-pitch electrode fingers arranged in mesh with one another, and a ground electrode arranged between adjacent electrode fingers of the interdigital electrodes, the adjacent electrode fingers are arranged at an interval smaller than or larger than half one pitch, and two AC voltages having a phase difference corresponding to the interval between the adjacent electrode fingers are applied to the respective interdigital electrodes, thereby generating the surface acoustic waves propagating in the single direction. The fluid actuator having this structure is different in the point that the same includes the two types of interdigital electrodes and the ground electrode in place of the three types of interdigital electrodes. The two AC voltages having the phase difference corresponding to the interval between the adjacent electrode fingers are applied to the respective interdigital electrodes. Thus, the fluid actuator can generate the surface acoustic waves having directivity in the single direction, for driving the fluid in the channel in the single direction. Further, the fluid actuator can also oppositely move the liquid in the channel by reversing the direction for changing the phases of the AC voltages applied to the two types of interdigital electrodes of the surface acoustic wave generating portion.

When the adjacent electrode fingers are arranged at the interval of half one pitch, the electrode fingers are symmetrically arranged, and the phase difference between the applied AC voltages is exactly 180° (reversal phase). Therefore, spatial directivity disappears and the fluid actuator cannot drive the liquid in the channel in the single direction, and hence it is necessary to arrange the adjacent electrode fingers at the interval smaller than or larger than half one pitch.

The following structures can be listed as preferable embodiments of the present invention:

When the fluid actuator further includes a substrate constituting another part of the inner wall of the fluid channel and the piezoelectric body is fitted into a part of the substrate, the piezoelectric body can be set on the portion generating the surface acoustic waves, and the substrate can be employed as the medium propagating the surface acoustic waves. Therefore, the size of the piezoelectric body can be reduced, whereby the cost for the overall fluid actuator can be reduced.

When the interdigital electrode of the fluid actuator according to the present invention has a common electrode connected with ends of the electrode fingers and the common electrode is arranged to be outside the fluid channel, the common electrode not directly generating the surface acoustic waves is provided outside the fluid channel and the interdigital electrode directly generating the surface acoustic waves can be formed on the overall channel, whereby the driving force for the fluid can advantageously be increased.

When not less than two surface acoustic wave generating portions are provided along the fluid channel and either surface acoustic wave generating portion is selectively driven, the fluid actuator can control the flow of the fluid in either direction by driving either one of the not less than two surface acoustic wave generating portions.

Particularly when the fluid actuator is provided with two surface acoustic wave generating portions, the two surface acoustic wave generating portions are arranged on positions shifted from the central position of the fluid channel sandwiched between the points C and D in both propagation directions of the surface acoustic waves respectively and either surface acoustic wave generating portion is selectively driven, the fluid actuator can control the flow of the fluid in either direction by driving either one of the two surface acoustic wave generating portions.

When the piezoelectric body of the fluid actuator is provided with a protective structure covering the interdigital electrode for preventing contact with the fluid while a gap is formed between the protective structure and the interdigital electrode, vibration of the surface acoustic wave generating portion is not hindered by the fluid, whereby larger driving force can be obtained. Further, damage of the directivity of the surface acoustic waves is also avoided.

When the protective structure includes a sidewall enclosing the gap and the thickness of the sidewall on the side of the single direction to which the surface acoustic waves from the surface acoustic wave generating portion propagate is smaller than the thickness on the side opposite to this single direction, the surface acoustic waves are harder to transmit through the thick portion of the sidewall than the thin portion, whereby the surface acoustic waves have directivity in the direction of the thin portion of the wall, and the fluid actuator can easily drive the liquid in the channel in the single direction.

When the fluid actuator further includes a vibration application means vibrating the inner wall of the fluid channel with ultrasonic waves, the fluid in the fluid channel can be effectively separated from the wall surface of the fluid channel, the resistance of the fluid channel can be reduced, and the fluid actuator can smoothen the flow of the fluid.

When the fluid channel is capable of circulating the fluid, the device can be cooled or heated by providing a heat exchanger or a radiator in this fluid channel.

A fluid actuator according to a further aspect of the present invention includes a piezoelectric body, a fluid channel having the piezoelectric body on a part of the inner wall thereof and capable of moving a fluid therein, and a surface acoustic wave generating portion driving the fluid in the fluid channel with surface acoustic waves generated from an interdigital electrode formed on a surface of the piezoelectric body facing the fluid channel, and the surface acoustic wave generating portion includes between adjacent electrode fingers of the interdigital electrode a floating electrode arranged parallelly to these electrode fingers on a position offset from the center between these electrode fingers toward the direction of either electrode finger. In the fluid actuator having this structure, the floating electrode asymmetrically reflects the surface acoustic waves, whereby directivity appears in the propagation direction of the surface acoustic waves. Surface acoustic waves having directivity in the single direction can be generated by applying an AC voltage to the interdigital electrode, whereby the fluid actuator can drive the liquid in the channel in the single direction.

The heat generating device according to the present invention is a heat generating device utilizing the fluid actuator as a cooler and has a substrate mounted with this heat generating device, while the fluid channel is provided on the substrate mounted with the heat generating device. According to this structure, the fluid channel can be utilized as a radiation channel passing through the vicinity of the heat generating device and can cool the heat generating device by moving heat generated from the substrate mounted with the heat generating device to the fluid, and high cooling efficiency can be expected.

The analysis device according to the present invention has a sample supply section supplying a fluidic sample and a sample analysis section analyzing the sample, while the fluid channel is so provided as to transport the fluidic sample from the sample supply section to the analysis section. While a conventional analysis device transports a sample through a principle of electrophoresis or the like and the treatable sample is therefore limited to an electrophoretically migrating sample not broken upon application of a high electric field, the analysis device according to the present invention moves the sample with the surface acoustic waves, whereby the type of the sample is not limited.

The foregoing and other objects, features and effects of the present invention will become more apparent from the following detailed description of the embodiments with reference to the attached drawings.

BRIEF DESCRIPTION OF THE DRAWINGS

FIG. 2(*b*) A perspective plan view of the fluid actuator shown in FIG. 2(*a*).

FIG. 3(*a*) A sectional view of the fluid actuator showing a state of bonding a piezoelectric body to the overall joint surface of a substrate.

FIG. 3(*b*) A sectional view of a fluid actuator obtained by forming a substrate itself by a piezoelectric body.

FIG. 4(*a*) An enlarged plan view of a piezoelectric substrate schematically showing the structure of the fluid actuator around a surface acoustic wave generating portion.

FIG. 4(*b*) A sectional view of the piezoelectric substrate shown in FIG. 4(*a*).

FIG. 4(*c*) A sectional view of the piezoelectric substrate shown in FIG. 4(*a*).

FIG. 5 A plan view showing another shape of a fluid channel of the fluid actuator.

FIG. 8(*a*) A plan view schematically showing an example of an arrangement of two surface acoustic wave generating portions in the fluid channel.

FIG. 8(*b*) A sectional view showing the example of the arrangement shown in FIG. 8(*a*).

FIG. 9(*a*) An enlarged plan view schematically showing a structural example for extracting electrodes from the surface acoustic wave generating portion.

FIG. 9(*b*) A sectional view of the structural example shown in FIG. 9(*a*).

FIG. 10(*a*) A front sectional view schematically showing a protective structure covering the interdigital electrode.

FIG. 10(*b*) A side sectional view showing the protective structure shown in FIG. 10(*a*).

FIG. 11(*b*) A sectional view showing the structure shown in FIG. 11(*a*).

FIG. 11(*c*) A sectional view showing the structure shown in FIG. 11(*a*).

FIG. 12(*b*) A perspective plan view of the fluid actuator shown in FIG. 12(*a*).

FIG. 13(*b*) A sectional view of the fluid actuator shown in FIG. 13(*a*).

FIG. 13(*c*) A sectional view of the fluid actuator shown in FIG. 13(*a*).

FIG. 17(*b*) A sectional view of the example of the arrangement shown in FIG. 17(*a*).

FIG. 18(*b*) A side sectional view showing the protective structure shown in FIG. 18(*a*).

FIG. 19(*b*) A side sectional view of the protective structure shown in FIG. 19(*a*).

FIG. 20(*a*) A sectional view schematically showing an example of a fluid actuator according to still another embodiment of the present invention.

FIG. 20(*b*) A perspective plan view of the fluid actuator shown in FIG. 20(*a*).

FIG. 21(*b*) A sectional view taken along the line I-I in FIG. 21(*a*).

FIG. 21(*c*) A sectional view taken along the line J-J in FIG. 21(*a*).

FIG. 21(*d*) A sectional view taken along the line H-H in FIG. 21(*a*).

FIG. 24 An enlarged plan view showing a modified structure of the interdigital electrode.

FIG. 25(*a*) A plan view schematically showing a structural example for extracting electrodes from the surface acoustic wave generating portion.

FIG. 25(*b*) A sectional view of FIG. 25(*a*).

FIG. 26(*a*) A plan view schematically showing a structural example of a heat generating device including the fluid actuator according to the present invention.

FIG. 26(*b*) A sectional view of FIG. 26(*a*).

FIG. 27(*a*) A plan view schematically showing a structural example of an analysis device including the fluid actuator according to the present invention.

FIG. 27(*b*) A sectional view of FIG. 27(*a*).

FIG. 28(*a*) An enlarged view of FIG. 27(*a*), showing a state where a sample fluid S is driven through a lateral fluid channel in the analysis device.

FIG. 28(*b*) An enlarged view of FIG. 27(*a*), showing a state where the sample fluid S is driven through a vertical fluid channel 2*a*.

FIG. 29(*a*) A plan view schematically showing a structural example of the heat generating device including the fluid actuator according to the present invention.

FIG. 29(*b*) A sectional view of FIG. 29(*a*).

DESCRIPTION OF THE REFERENCE NUMERALS

Figure 1:
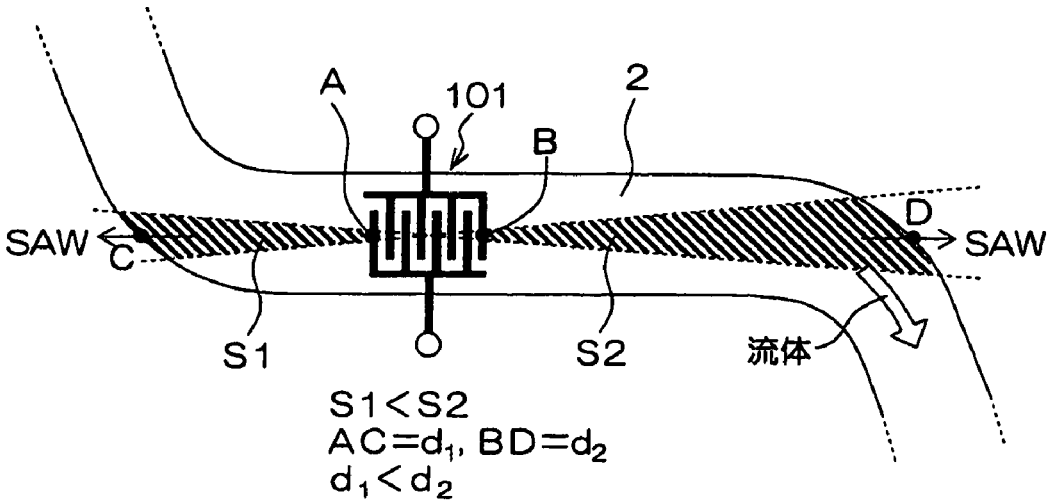
FIG. 1 A schematic plan view for illustrating a principle of the present invention for driving a fluid in a single direction.

101, 102, 103 surface acoustic wave generating portion

2 fluid channel

3 substrate
4 lid body
5 power source
6 container
8 insulating film
13 ground electrode
14*a*, 14*b*, 14*c* bus-bar electrode
15*a*, 15*b*, 15*c* interdigital electrode
15*d*, 15*e* floating electrode
16*a*, 16*b*, 16*c* via electrode connecting portion
17*a*, 17*b*, 17*c* via electrode
18*a*, 18*b*, 18*c* external electrode
20*a*, 20*b*, 20*c* extraction electrode
21 reflector electrode
32 heat generating section
40 analysis device
43 analysis section
51 protective structure
52 void
61 piezoelectric vibrator

BEST MODE FOR CARRYING OUT THE INVENTION

The fluid actuator according to the present invention as well as the heat generating device and the analysis device employing the same are described in detail with reference to the drawings.

Figure 2:
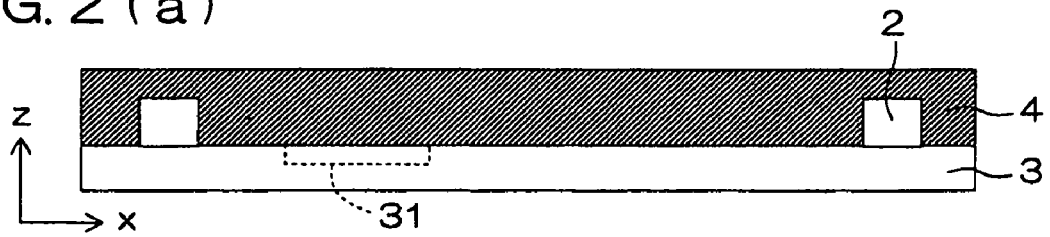
FIG. 2(*a*) A sectional view schematically showing an embodiment of a fluid actuator according to the present invention.
Figure 2:
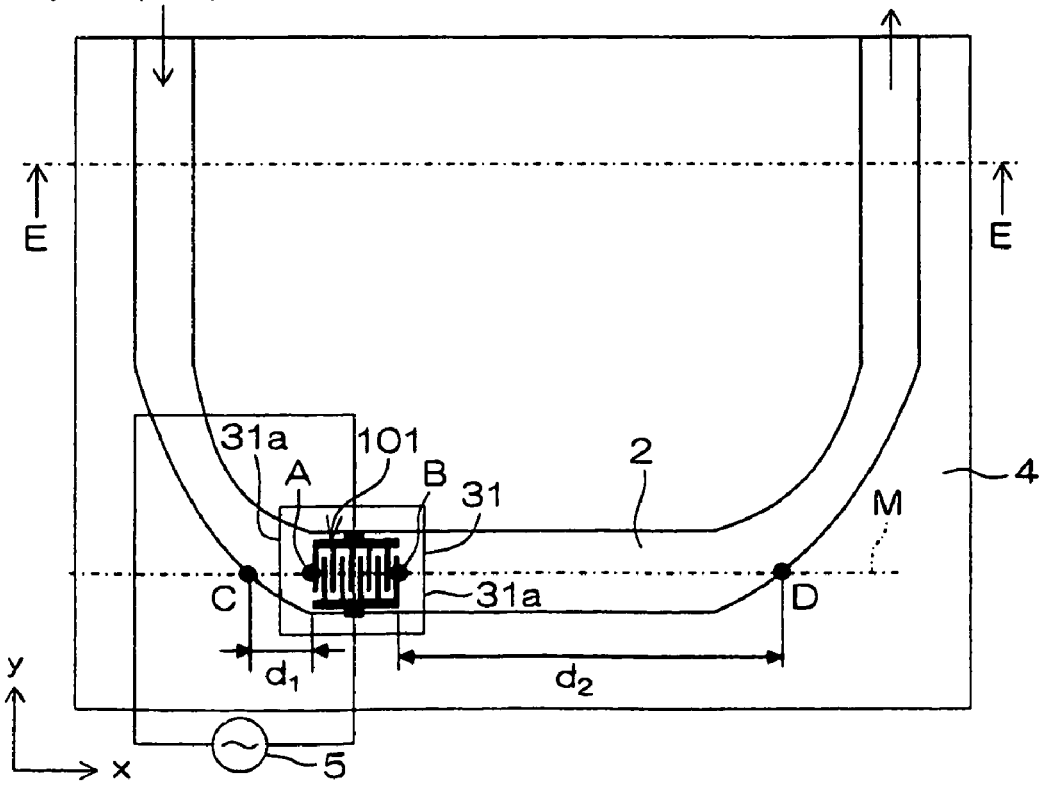

FIGS. 2(*a*) and 2(*b*) are a sectional view and a perspective plan view showing an embodiment of the fluid actuator according to the present invention. FIG. 2(*a*) is a sectional view taken along the line E-E in FIG. 2(*b*).

In this fluid actuator, two vertical flat plates 4 and 3 are bonded to each other. The bonded surfaces of the flat plates 4 and 3 are referred to as "joint surfaces". A sectionally rectangular groove U-shaped in plan view is formed on the joint surface of the upper flat plate 4 (hereinafter referred to as "lid body 4"). This U-shaped groove forms a void defining a fluid channel 2 capable of moving a fluid therein when the two vertical flat plates 4 and 3 are attached to each other.

The sectional shape of the fluid channel 2 is not restricted to the rectangular shape shown in FIG. 2(*a*), but may be a semicircular or triangular sectional shape. The plane shape of the fluid channel 2 is not restricted to the U-shaped one shown in FIG. 2(*b*) either, but may be an arcuate shape or a perpendicularly bent shape.

Further, a piezoelectric body 31 is fitted into a part of the joint surface of the lower flat plate 3 (hereinafter referred to as "substrate 3") to face the fluid channel 2. This piezoelectric body 31 forms a part of the inner wall surface of the fluid channel 2.

While any substrate such as a piezoelectric ceramic substrate or a piezoelectric single-crystalline substrate having piezoelectricity may be employed for the piezoelectric body 31, a single-crystalline substrate of lead zirconate titanate, lithium niobate or lithium tantalate having high piezoelectricity is preferably employed.

The piezoelectric body 31 may not be fitted into the part of the substrate 3, but the piezoelectric body 31 may be attached to the overall joint surface of the substrate 3, as shown in FIG. 3(*a*). Alternatively, the substrate 3 itself may be formed by the piezoelectric body 31, as shown in FIG. 3(*b*).

When the piezoelectric body 31 is fitted into the part of the substrate 3, the substrate 3 is preferably made of such a material that surface acoustic waves can propagate along the surface thereof without attenuation. In particular, a material having such a close coefficient of elasticity that the propagation velocity of the surface acoustic waves on the substrate 3 and the propagation velocity on the piezoelectric body 31 generally coincide with each other is preferably selected for the substrate 3, in order to reduce reflection of the surface acoustic waves on the joint surfaces of the substrate 3 and the piezoelectric body 31. A material of the same quality as the piezoelectric body 31 or lead zirconate titanate, for example, can be listed as such a material for the substrate 3.

When the piezoelectric body 31 is fitted into the part of the substrate 3, the piezoelectric body 31 and the substrate 3 are preferably directly in contact with each other on an interface 31*a* therebetween in the propagation direction (direction x) of the surface acoustic waves, without sandwiching a resin layer for bonding or the like. On the interface between the piezoelectric body 31 and the substrate 3 in a direction other than the propagation direction of the surface acoustic waves, a surface wave absorbing structure of resin or the like is preferably provided, in order to reduce a bad influence exerted by reflection of the surface acoustic waves on the interface between the piezoelectric body 31 and the substrate 3.

When the piezoelectric body 31 is attached to the overall substrate 3 as shown in FIG. 3(*a*), the material for the substrate 3 may not be taken into consideration dissimilarly to the above. The substrate 3 itself can be constituted of the piezoelectric body 31, as shown in FIG. 3(*b*). In this case, the piezoelectric body 31 may be rectangularly formed for matching the driving direction (direction x) for the fluid and the long-side direction of the piezoelectric body 31 each other, in order to attain larger driving force. Further, a surface wave absorbing structure is preferably provided on the interface between the piezoelectric body 31 and the substrate 3, in order to reduce a bad influence exerted by reflection of the surface acoustic waves on the interface between the attached piezoelectric body 31 and the substrate 3. A general resin layer can be employed as this surface wave absorbing structure.

On the main surface of the piezoelectric body 31 facing the fluid channel 2, a pair of interdigital (comb-shaped) electrodes (also referred to as IDT; Inter Digital Transducer electrodes) 15*a* and 15*b* are formed in mesh with each other. This portion where the interdigital electrodes 15*a* and 15*b* are formed on the piezoelectric body 31 is referred to as a surface acoustic wave generating portion 101.

As shown in FIG. 4(*b*) described later, the interdigital electrodes 15*a* and 15*b* provided on the piezoelectric substrate 31 are covered with an insulating film 8. The interdigital electrodes 15*a* and 15*b* are so covered with the insulating film 8 that deterioration of the electrodes caused by migration or the like and denaturing of the fluid caused by an electric field can be desirably prevented.

In this structure shown in FIG. 2(*b*), a virtual line M generally passing through the central portion of the surface acoustic wave generating portion 101 is drawn toward the propagation directions of the surface acoustic waves, i.e., the direction x and a direction −x, through the surface of the piezoelectric body 31. Then, the fluid channel 2 and the surface acoustic wave generating portion 101 are observed in plan view from a direction (direction z) orthogonal to the piezoelectric body 31, as shown in FIG. 2(*b*). In this case, the virtual line M extends from both ends A and B of the surface acoustic wave generating portion 101, and intersects with the wall surface of the fluid channel 2 at points C and D respectively.

According to this embodiment, a distance $d_1$ between A and C and a distance $d_2$ between B and D are in a nonidentical relation, more specifically in the relation $d_1<d_2$ in FIG. 2(*b*). The reason for employing this arrangement is described later.

FIGS. 4(*a*) to 4(*c*) are enlarged schematic views showing a portion around the surface acoustic wave generating portion 101; FIG. 4(*a*) is a plan view of the piezoelectric substrate, and FIGS. 4(*b*) and 4(*c*) are sectional views thereof.

Common electrodes (bus-bar electrodes) 14*a* and 14*b* are formed on the piezoelectric body 31 in parallel with each other, and the interdigital electrodes 15*a* and 15*b* are so formed as to mesh with each other perpendicularly from the respective bus-bar electrodes 14*a* and 14*b*. A via electrode connecting portion 16*a* is formed on the outer side of the bus-bar electrode 14*a*, and another via electrode connecting portion 16*b* is formed on the outer side of the bus-bar electrode 14*b*.

The via electrode connecting portion 16*a* is connected to an external electrode 18*a* formed on the back surface of the substrate 3 through a via electrode 17*a* passing through the piezoelectric body 31 and the substrate 3, while the via electrode connecting portion 16*b* is connected to another external electrode 18*b* formed on the back surface of the substrate 3 through another via electrode 17*b* passing through the piezoelectric body 31 and the substrate 3.

AC voltages are supplied to the external electrodes 18*a* and 18*b* from an AC power source 5. The AC voltages are applied to the respective interdigital electrodes 15*a* and 15*b*. Consequently, progressive waves of surface acoustic waves having displacement components in the directions x and z shown in FIG. 4(*c*) propagate in the directions x and −x from the surface acoustic wave generating portion 101 along the wall surface of the fluid channel 2 (the joint surface of the substrate 3).

The fluid in contact with the wall surface of the fluid channel 2 is driven by these progressive waves of the surface acoustic waves in the progressive directions (the directions x and −x) of the surface acoustic waves (as to this mechanism, refer to Patent Documents 1 and 2 and Non-Patent Document 1).

Assuming that v represents the propagation velocity of the surface acoustic waves and p represents the structural period of the interdigital electrodes 15*a* and 15*b*, AC voltages having frequencies f satisfying the following formula:

$$v=fp$$

are preferably applied to the interdigital electrodes 15*a* and 15*b*, since the structural period p of the interdigital electrodes 15*a* and 15*b* and the wavelength λ of the generated surface acoustic waves thus coincide with each other, and surface acoustic wave vibration of a large amplitude can be obtained and the driving efficiency for the fluid is improved.

If the surface acoustic wave generating portion 101 has a symmetrical structure with respect to the fluid channel 2, i.e., such a structure that the distance $d_1$=the distance $d_2$, the surface acoustic waves propagating from the interdigital electrodes 15*a* and 15*b* in the directions x and −x propagate at generally identical velocities, and hence fluids of the same flow rates are going to flow in the directions x and −x around the surface acoustic wave generating portion 101. Therefore, the fluid remains unmoved as a whole.

According to this embodiment, therefore, the distances $d_1$ and $d_2$ are in the nonidentical relation as hereinabove described; more specifically, the surface acoustic wave generating portion 101 is arranged in the vicinity of one end of the linear portion of the fluid channel 2, as shown in FIG. 2(*b*). The relation $d_1<d_2$ is satisfied due to this arrangement.

While the fluid present in the portion of the fluid channel 2 rightward of the surface acoustic wave generating portion 101 is driven by the rightward surface acoustic waves on the wall surface of the fluid channel in FIG. 2(*b*), the fluid channel 2 is bent on the portion leftward of the surface acoustic wave generating portion 101, the leftward surface acoustic waves leak out from the fluid channel 2, and leftward fluid driving efficiency is reduced. Therefore, the rightward flow rate surpasses the leftward flow rate, and the fluid is rightwardly driven as a whole.

In order to sufficiently attenuate the leftward flow rate, the distance $d_1$ is preferably not more than 20 mm.

Thus, the interdigital electrodes 15*a* and 15*b* can generate rightwardly and leftwardly unbalanced surface acoustic waves, for unidirectionally driving the fluid in the fluid channel 2 as a whole.

The fluid actuator according to the present invention is not restricted to the aforementioned mode. For example, the shape of the fluid channel 2 is not restricted to the U shape shown in FIG. 2(*b*), but may be a perpendicularly bent shape, as shown in FIG. 5. A wall surface 200 of the fluid channel 2 closer to the surface acoustic wave generating portion 101 is a plane generally orthogonal to the propagation directions of the surface acoustic waves, whereby the surface acoustic waves directed from the point A toward the point C are partially reflected on the point C and progress in the same direction of the surface acoustic waves directed from the point B toward the point D in a superposed manner, and the fluid also more strongly flows in the direction from the point B toward the point D.

Figure 6:
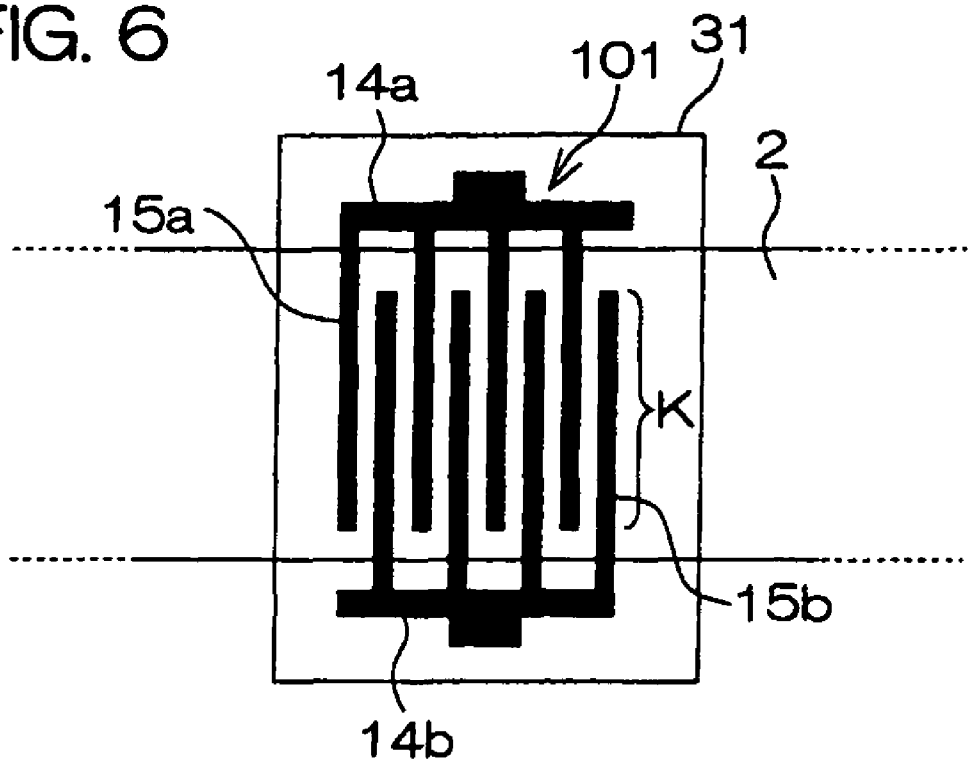
FIG. 6 A plan view showing an interdigital electrode set to extrude from the fluid channel.

The bus-bar electrodes 14*a* and 14*b* may be formed outside the fluid channel 2, as shown in FIG. 6. Thus, the bus-bar electrodes 14*a* and 14*b* which are the common electrodes not directly generating the surface acoustic waves are present outside the fluid channel 2 and the interdigital electrodes 15*a* and 15*b* directly generating the surface acoustic waves can be formed on the overall fluid channel 2, whereby the driving force for the fluid can advantageously be increased.

Figure 7:
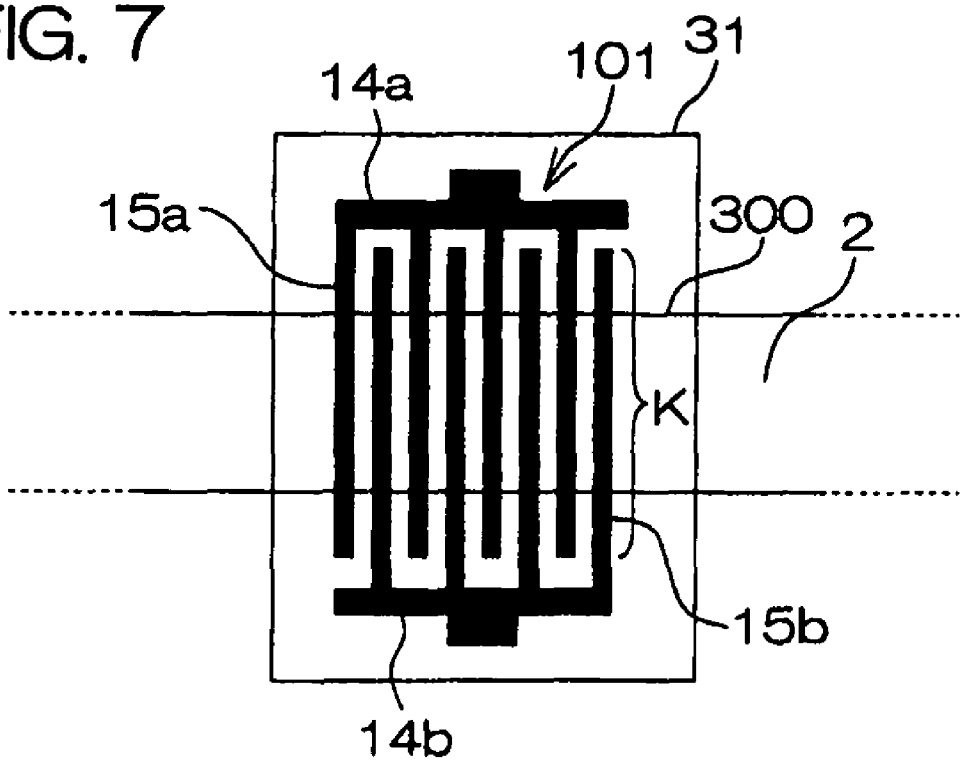
FIG. 7 A plan view showing the interdigital electrode set to extrude from the fluid channel.

On the other hand, a portion K where the interdigital electrodes 15*a* and 15*b* mesh with each other may spread toward the outside of the fluid channel 2, as shown in FIG. 7. In this case, a junction 300 between the piezoelectric substrate 31 and the lid body 4 is present in the portion K where the interdigital electrodes 15*a* and 15*b* mesh with each other. In this case, this junction 300 may inhibit vibration of the surface acoustic waves while the junction 300 may be damaged or detached due to the vibration of the surface acoustic waves, and hence the portion K where the interdigital electrodes 15*a* and 15*b* mesh with each other is preferably present in the fluid channel 2.

The surface acoustic waves unidirectionally propagate at a certain angle depending on the anisotropy of the piezoelectric substrate, whereby such a piezoelectric substrate may be so formed as to match the propagation directions of the surface acoustic waves on the piezoelectric substrate and the direction of the fluid channel 2 provided with the surface acoustic wave generating portion 101 to each other.

As hereinabove described, this fluid actuator can drive the fluid in a desired direction, while capability of switching the flow of the fluid is required in an analysis device or the like.

In this case, not less than two surface acoustic wave generating portions may be provided, as shown in FIGS. 8(*a*) and 8(*b*). Referring to FIGS. 8(*a*) and 8(*b*), surface acoustic wave generating portions 101*a* and 101*b* are provided separately on positions close to the left and right ends of the linear portion of the fluid channel 2 respectively. An AC voltage may be supplied to only the left surface acoustic wave generating portion 101*a* with a switch SW in order to rightwardly drive the fluid, and the AC voltage may be supplied to only the right surface acoustic wave generating portion 101*b* with the switch SW in order to leftwardly drive the fluid.

FIGS. 9(*a*) and 9(*b*) schematically illustrate another example of a structure for extracting the electrodes from the surface acoustic wave generating portion 101.

In the fluid actuator shown in FIGS. 9(*a*) and 9(*b*), extraction electrodes 20*a* and 20*b* extending from the interdigital electrodes 15*a* and 15*b* toward the side end surfaces of the substrate 3 are formed on the substrate 3.

In order to manufacture this fluid actuator, the extraction electrodes 20*a* and 20*b* extending from the interdigital electrodes 15*a* and 15*b* toward the side end surfaces of the substrate 3 are simultaneously formed on the substrate 3 in the step of preparing the interdigital electrodes 15*a* and 15*b*. Thereafter side electrodes 18*a* and 18*b* linked with the extraction electrodes 20*a* and 20*b* are formed on the side end surfaces of the substrate 3. Then, the lid body 4 provided with the fluid channel 2 and the substrate 3 are bonded to each other through PDMS (poly dimethylsiloxane), which is a kind of silicone rubber, for example, and the fluid channel 2 is airtightly sealed, for completing the fluid actuator.

In this example shown in FIGS. 9(*a*) and 9(*b*), the substrate 3 may not be provided with a via hole (through-hole) passing through the piezoelectric body 31, dissimilarly to FIG. 4(*b*). While the piezoelectric body 31 may be cracked or broken when provided with the through-hole, no through-hole may be provided when the structure shown in FIGS. 9(*a*) and 9(*b*) is employed, whereby the piezoelectric body 31 can be prevented from cracking or breaking.

FIGS. 10(*a*) and 10(*b*) illustrate another embodiment of the fluid actuator according to the present invention. In a surface acoustic wave generating portion 101, a protective structure 51 is so provided that a pair of interdigital electrodes 15*a* and 15*b* are not directly in contact with a fluid in a fluid channel 2. A void 52 is formed between this protective structure 51 and the interdigital electrodes 15*a* and 15*b*. Therefore, no fluid comes into contact with the surface acoustic wave generating portion 101, vibration generated from the surface acoustic wave generating portion 101 is not hindered by any fluid, and larger driving force can be obtained.

In such a structure, a pattern is prepared on the interdigital electrodes 15*a* and 15*b* with amorphous silicon, for example, as a sacrifice layer for forming a hollow structure later. A silicon nitride film is formed thereon as the protective structure. A hole is formed in a part of the silicon nitride film, internal amorphous silicon is removed with xenon fluoride, for example, by etching the sacrifice layer, and the hole formed in the silicon nitride film is finally filled up. Silicon oxide may be employed in place of the silicon nitride. The void 52 is filled with air or nitrogen.

The protective structure can be made of any one of a metallic material, an organic material and an inorganic material. The aforementioned method of manufacturing the protective structure is a mere example, and the protective structure may be prepared from an organic material such as durable photoresist, for example, in place of the aforementioned method.

Figure 11:
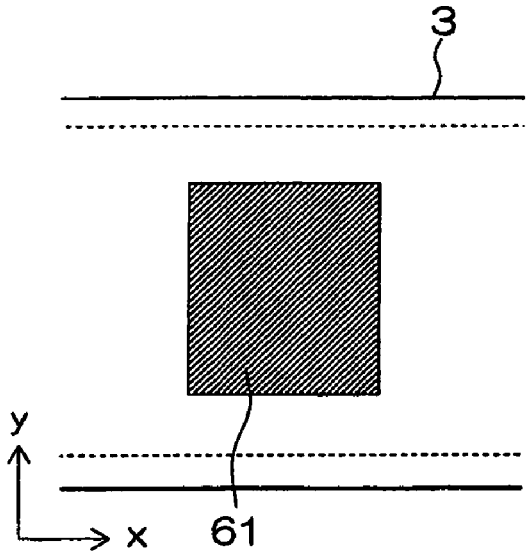
FIG. 11(*a*) A plan view showing a structural example of the fluid actuator according to the present invention mounted with a piezoelectric vibrator.
Figure 11:
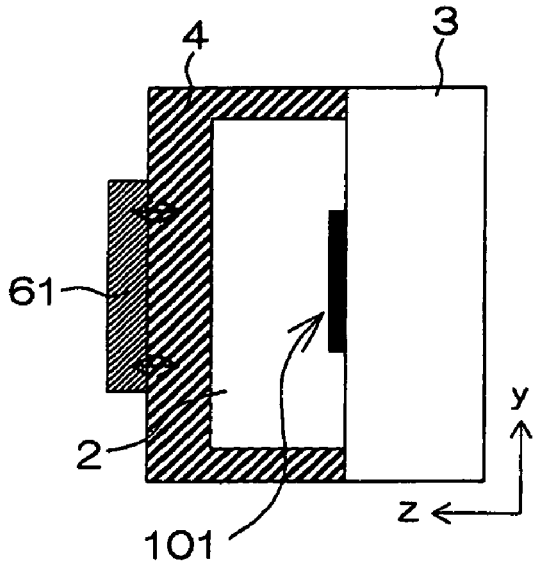
Figure 11:
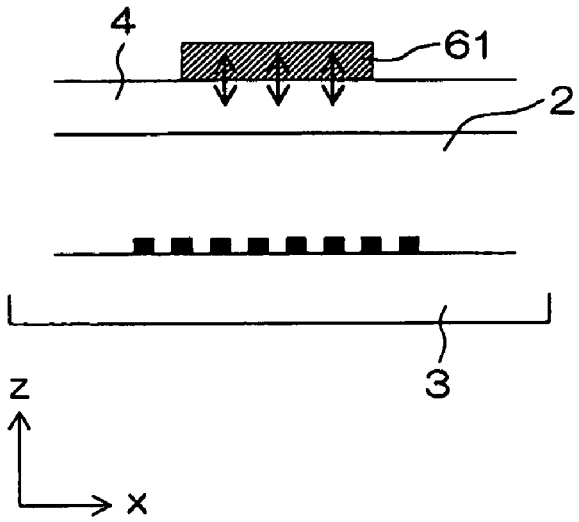

FIGS. 11(*a*) to 11(*c*) illustrate still another embodiment of the fluid actuator according to the present invention.

According to this embodiment, a piezoelectric vibrator 61 is mounted on the outer wall surface of a fluid channel 2 as an example of a vibration applying means so that the inner wall of the fluid channel 2 can be vibrated with ultrasonic waves, in addition to a surface acoustic wave generating portion 101. The piezoelectric vibrator 61 is vibrated by an unillustrated electrode and an unillustrated AC power source.

Thus, the inner wall surface of the fluid channel 2 ultrasonically vibrates. Therefore, a fluid in the fluid channel 2 hardly adheres to the wall surface of the fluid channel 2, and passage resistance of the fluid channel 2 can be reduced.

Figure 12:
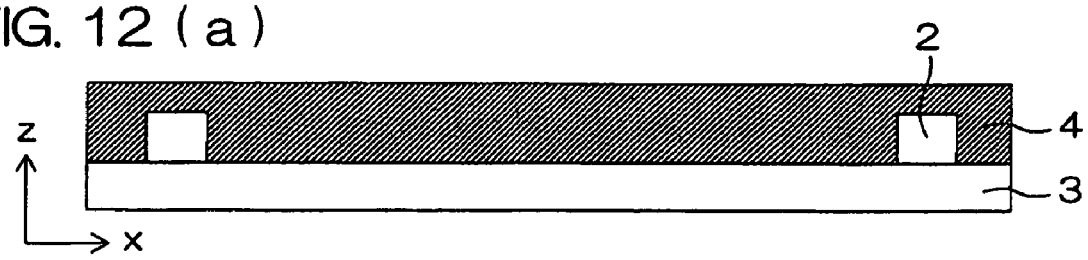
FIG. 12(*a*) A sectional view schematically showing an example of a fluid actuator according to another embodiment of the present invention.
Figure 12:
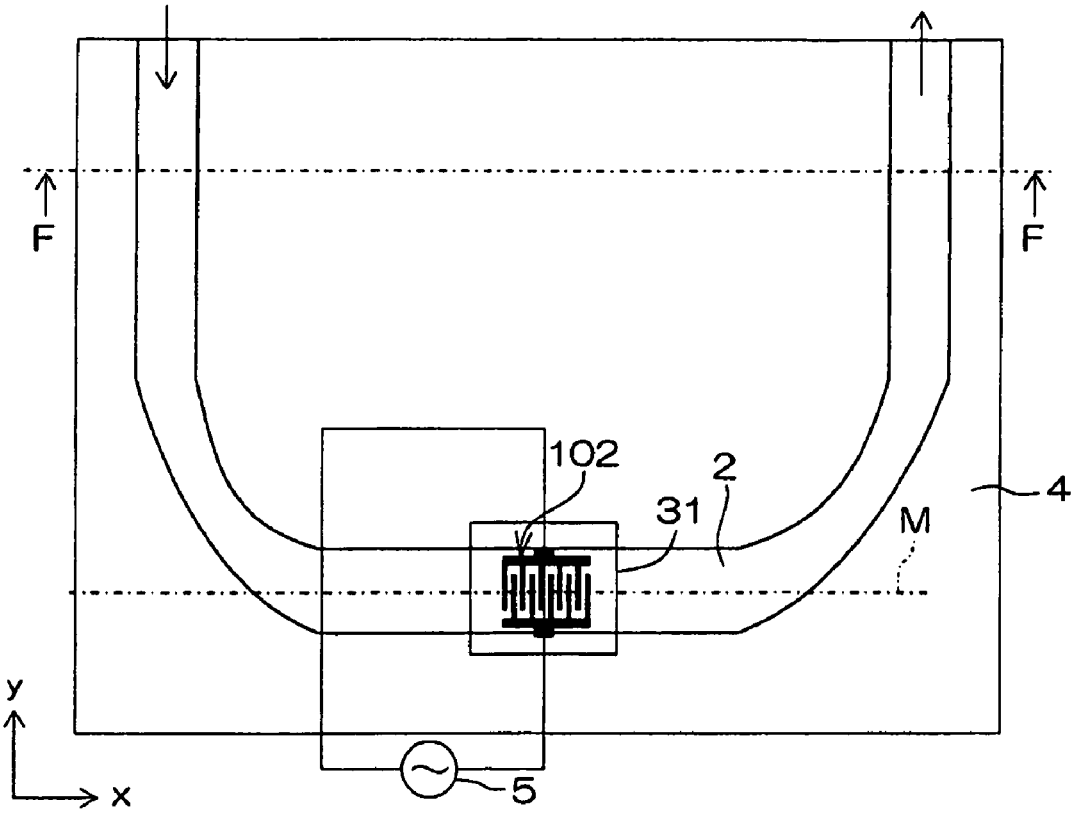

FIGS. 12(*a*) and 12(*b*) are a sectional view and a perspective plan view showing an example of a further embodiment of the fluid actuator according to the present invention. FIG. 12(*a*) is a sectional view taken along the line F-F in FIG. 12(*b*).

A U-shaped fluid passage 2 is formed by boding a lid body 4 and a substrate 3 to each other and a piezoelectric body 31 is fitted into a part of the joint surface of the substrate 3 to face the fluid channel 2, similarly to the above description with reference to FIGS. 2(*a*) and 2(*b*). In this embodiment, the plane shape of the fluid channel 2 may be U-shaped, arcuate or perpendicularly bent, or may be linear in addition thereto. The fluid channel 2 may be linearly shaped since a surface acoustic wave generating portion 102 itself has ability to unidirectionally drive a fluid, as described later.

The piezoelectric body 31 may not be fitted into the part of the substrate 3 but may be attached to the overall substrate 3, or the substrate 3 itself may be formed by the piezoelectric body 31, similarly to the above description with reference to FIGS. 3(*a*) and 3(*b*).

Figure 13:
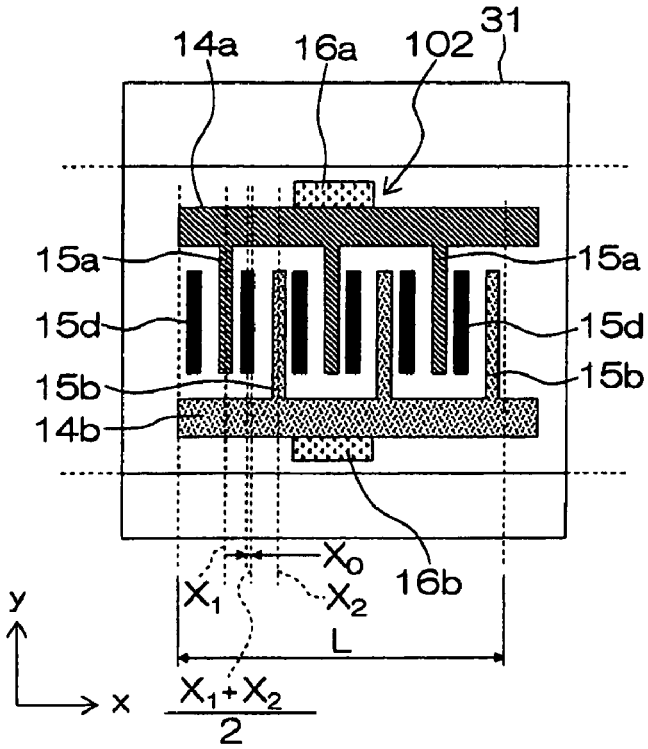
FIG. 13(*a*) An enlarged plan view schematically showing the structure of the fluid actuator around a surface acoustic wave generating portion.
Figure 13:
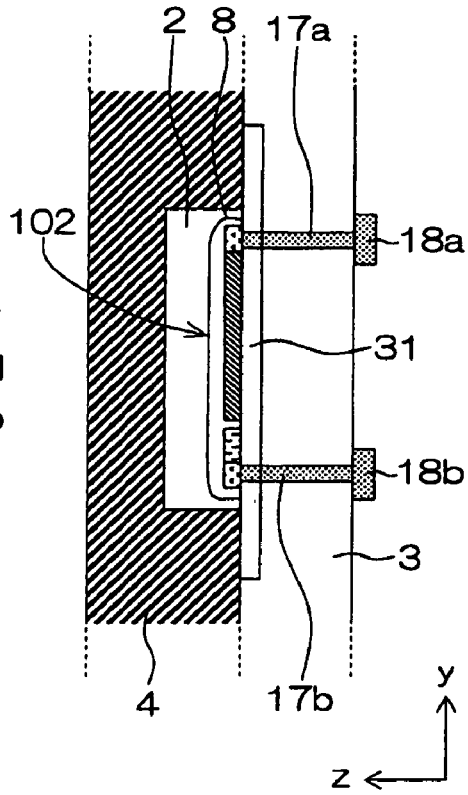
Figure 13:
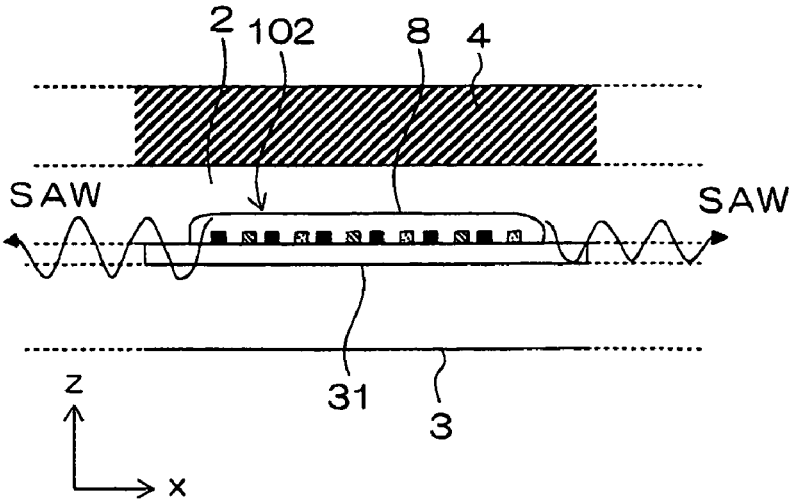

FIGS. 13(*a*) to 13(*c*) are enlarged views schematically showing the structure of an example of the surface acoustic wave generating portion 102 related to the fluid actuator according to this embodiment. FIG. 13(*a*) is a plan view of a piezoelectric substrate, and FIGS. 13(*b*) and 13(*c*) are sectional views.

In the example shown in FIG. 13(*a*), a pair of interdigital electrodes 15*a* and 15*b* are formed on the piezoelectric body 31 in mesh with each other, and floating electrodes 15*d* are further provided as a characteristic structure. The portion of the piezoelectric body 31 provided with the interdigital electrodes 15*a* and 15*b* and the floating electrodes 15*d* is referred to as the surface acoustic wave generating portion 102.

As shown in FIG. 13(*b*), the interdigital electrodes 15*a* and 15*b* and the floating electrodes 15*d* provided on the piezoelectric substrate 31 are covered with an insulating film 8. The advantage obtained by covering the electrodes with the insulating film 8 is as described above with reference to FIG. 4(*b*).

Common electrodes (bus-bar electrodes) 14*a* and 14*b* are provided in parallel with each other on the piezoelectric body 31 partially constituting the wall surface of the fluid channel 2, and the interdigital electrodes 15*a* and 15*b* are perpendicularly formed from the respective bus-bar electrodes 14*a* and 15*b* to mesh with each other. A floating electrode 15*d* electrically connected with no elements is formed between the adjacent bus-bar electrodes 14*a* and 15*b*.

A via electrode connecting portion 16*a* is formed on the outer side of the bus-bar electrode 14*a*, and another via electrode connecting portion 16*b* is formed on the outer side of the bus-bar electrode 14*b*.

The via electrode connecting portion 16*a* is connected to an external electrode 18*a* formed on the back surface of the substrate 3 through a via electrode 17*a* passing through the piezoelectric body 31 and the substrate 3, while the via electrode connecting portion 16*b* is connected to an external electrode 18*b* formed on the back surface of the substrate 3 through a via electrode 17*b* passing through the piezoelectric body 31 and the substrate 3.

Each of the floating electrodes 15*d* is so arranged that the centerline of the floating electrode 15*d* is located on a position shifted from a line $(x_1+x_2)/2$ passing through the center between a centerline $x_1$ of the adjacent interdigital electrode 15*a* and a centerline $x_2$ of the interdigital electrode 15*b* by $x_0$ in either predetermined direction, as shown in FIG. 13(*a*). This $x_0$ is referred to as "offset". It is assumed that $x_1$ and $x_2$ are distances from a certain reference point.

AC voltages are supplied to the external electrodes 18*a* and 18*b* from an AC power source 5. The AC voltages are applied to the respective ones of the interdigital electrodes 15*a* and 15*b*, and progressive waves of surface acoustic waves having displacement components in directions x and y shown in FIG. 13(*c*) propagate in a direction x or a direction −x from the surface acoustic wave generating portion 102 along the wall surface of the fluid channel 2 (the joint surface of the substrate 3).

These elastic surface progressive waves drive the fluid in contact with the wall surface of the fluid channel 2 in the progressive direction of the surface acoustic waves.

If the surface acoustic wave generating portion 102 has a symmetrical structure with respect to the fluid channel 2, i.e., such a structure that the offset $x_0$ of the floating electrodes 15*d*=0, the surface acoustic waves propagating from the interdigital electrodes 15*a* and 15*b* in the directions x and −x propagate with generally identical strength, whereby fluids of the same flow rates are going to flow in the directions x and −x about the surface acoustic wave generating portion 102. Therefore, the fluid remains unmoved as a whole.

According to this embodiment, however, each floating electrode 15*d* is arranged on the position shifted from the centerline $(x_1+x_2)/2$ between the centerlines $x_1$ and $x_2$ of the adjacent interdigital electrodes 15*a* and 15*b* by $x_0$ in either predetermined direction, as described above. The surface acoustic waves strongly propagate either in the direction x or in the direction −x, depending on the sign (positive or negative) of the offset $x_0$ of the floating electrode 15*d* from the center between the interdigital electrodes 15*a* and 15*b*. This is because the floating electrode is arranged on a spatially asymmetrical position, and hence the surface acoustic waves are also asymmetrically reflected by the floating electrode and the propagation direction of the surface acoustic waves is biased either toward the direction x or toward the direction −x.

Thus, the fluid actuator can unidirectionally drive the fluid in the fluid channel 2 as a whole by generating surface acoustic waves of the predetermined direction from the interdigital electrodes 15*a* and 15*b*.

While FIG. 13 show the open floating electrodes electrically connected with no elements as the floating electrodes, short-circuit floating electrodes formed by connecting adjacent floating electrodes with each other may be employed in place of the open floating electrodes. Alternatively, the fluid actuator may have both of open floating electrodes and short-circuit floating electrodes.

Figure 14:
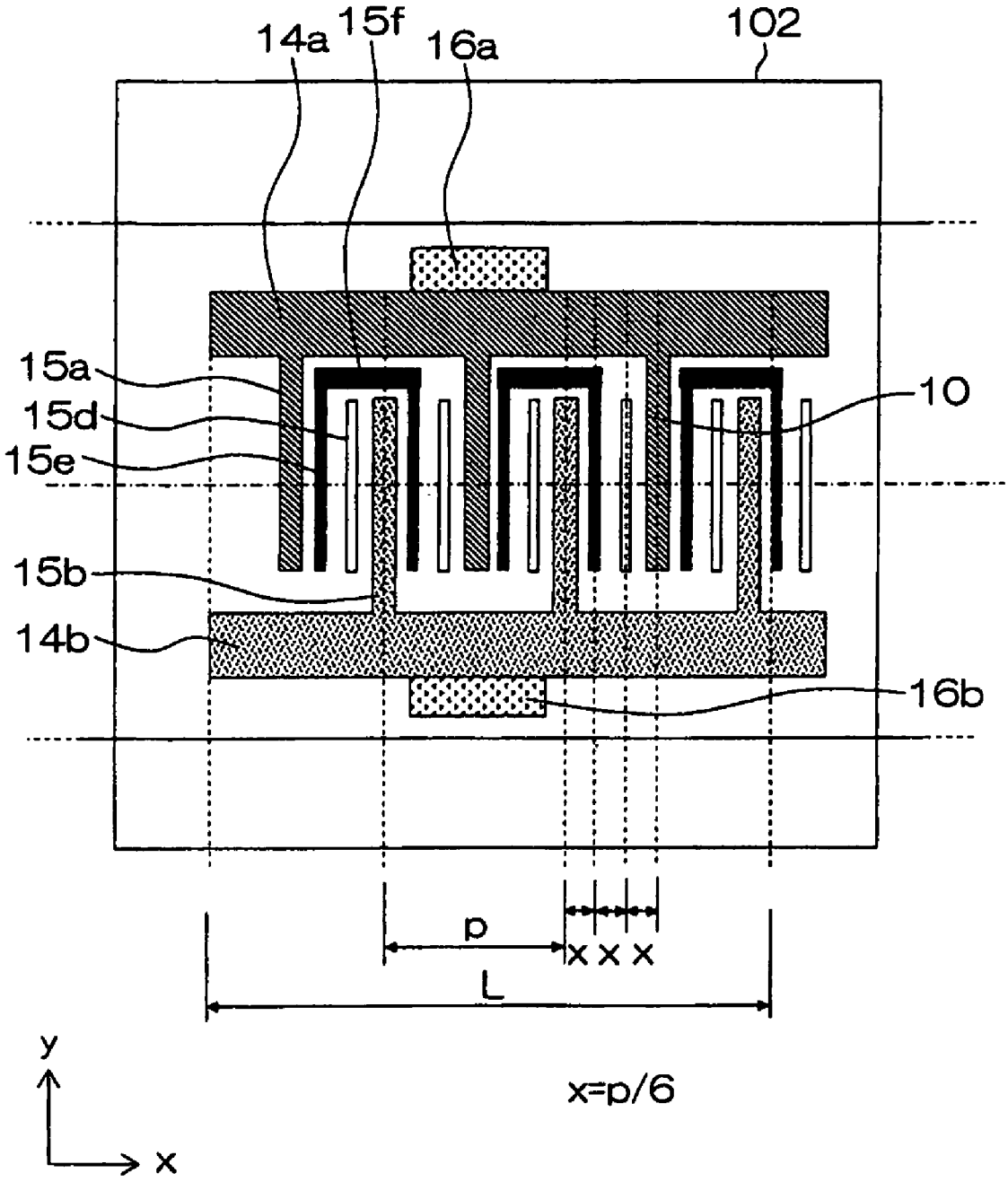
FIG. 14 An enlarged plan view showing another structure around the surface acoustic wave generating portion.

FIG. 14 is an enlarged view showing a floating electrode structure including both of open floating electrodes 15*d* and short-circuit floating electrodes 15*e*. A piezoelectric body 31 is provided thereon with a pair of interdigital electrodes 15*a* and 15*b* in mesh with each other, and further provided with the open floating electrodes 15*d* and the short-circuit floating electrodes 15*e*.

Each of the open floating electrodes 15*d* is arranged on a position shifted from the centerline $(x_1+x_2)/2$ between the centerlines $x_1$ and $x_2$ of the adjacent interdigital electrodes 15*a* and 15*b* in either predetermined direction (direction +x in this case), similarly to the above. In other words, the open floating electrode 15*d* has a positive offset.

Each short-circuit floating electrode 15*e* is arranged on a position shifted from the centerline $(x_1+x_2)/2$ between the centerlines $x_1$ and $x_2$ of the adjacent interdigital electrodes 15*a* and 15*b* in the opposite direction (direction −x in this case). In other words, the sign of the offset is negative.

Therefore, the short-circuit floating electrodes 15*e* and the open floating electrodes 15*d* intervene between the interdigital electrodes 15*a* and 15*b*. The short-circuit floating electrodes 15*e* are connected with each other by auxiliary electrode 15*f* over the interdigital electrode 15*b*. Thus, the respective electrodes are arranged in the order of the interdigital electrode 15*a*, the short-circuit electrode 15*e*, the open floating electrode 15*d*, the interdigital electrode 15*b*, the short-circuit floating electrode 15*e* and the open floating electrode 15*d* generally at regular intervals. In other words, the respective electrodes are arranged at intervals of p/6 with respect to the structural period p of the interdigital electrodes 15*a* and 15*b*.

The feature of this electrode structure resides in that reflection of surface acoustic waves by the open floating electrodes 15*d* and reflection of surface acoustic waves by the short-circuit floating electrodes 15*e* are combined with each other, whereby force for unidirectionally driving a fluid is stronger than a case of independently employing the respective ones.

When the short-circuit floating electrodes 15*e* and the open floating electrodes 15*d* are formed on the same positions independently of one another, for example, surface acoustic waves flow in exactly opposite directions due to the difference in reflective behavior between the respective floating electrodes. In order to match the flowing directions of the surface acoustic waves each other, it is desirable to form the short-circuit floating electrodes 15*e* on the positions close to the interdigital electrode 15*a* and to arrange the open floating electrodes 15*d* closely to the interdigital electrode 15*b*, as shown in FIG. 14. In other words, the offset signs are set to positive and negative respectively. Thus, strong fluid driving force can be obtained by synchronizing the reflection of the surface acoustic waves by the open floating electrodes 15*d* and the reflection of the surface acoustic waves by the short-circuit floating electrodes 15*e* with each other.

Figure 15:
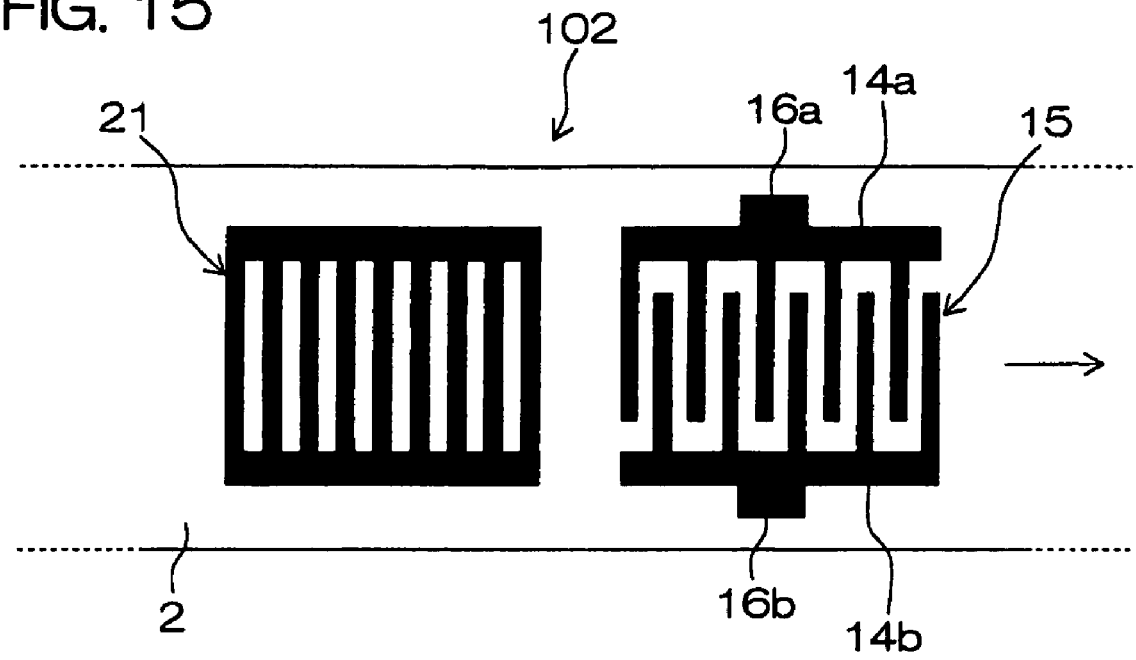
FIG. 15 An enlarged plan view showing the structure of a surface acoustic wave generating portion including a reflector electrode.

FIG. 15 is an enlarged plan view showing another example of the surface acoustic wave generating portion 102 related to the fluid actuator according to the present invention. Thus, surface acoustic waves of a predetermined direction can also be generated through a reflector electrode, without employing floating electrodes.

In other words, a reflector electrode 21 is arranged along a fluid channel 2 adjacently to interdigital electrodes 15*a* and 15*b* (generically referred to as an interdigital electrode 15) for reflecting surface acoustic waves generated in and propagating from the interdigital electrode 15 in the opposite direction.

While the interdigital electrode 15*a* is arranged by meshing electrode fingers of the interdigital electrode having the electrode fingers, no floating electrodes are provided on the interdigital electrode 15 in this structure shown in FIG. 15.

However, the reflector electrode 21 is provided, so that this reflector electrode 21 reflects surface acoustic waves generated in the interdigital electrode 15 and propagating in the direction (leftward in FIG. 15) toward the reflector electrode 21 in the opposite direction (rightward in FIG. 15) when an AC voltage is applied to the interdigital electrode for generating the surface acoustic waves. Thus, the propagation direction of the surface acoustic waves can be unidirectionally adjusted, for unidirectionally driving a fluid in the fluid channel 2 as a whole. While the reflector electrode 21 is described as a grating electrode, the present invention is not restricted to this but an interdigital electrode may alternatively be employed.

Figure 16:
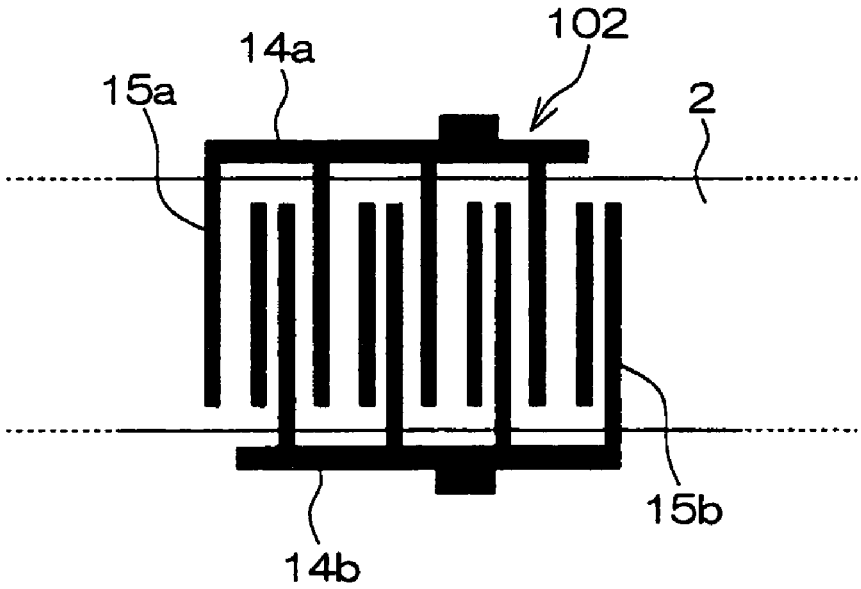
FIG. 16 An enlarged plan view showing still another structure around the surface acoustic wave generating portion.

The fluid actuator according to the present invention is not restricted to the aforementioned structure. For example, bus-bar electrodes 14*a* and 14*b* may be formed on the outer side of the fluid channel 2, as shown in FIG. 16. Thus, the bus-bar electrodes 14*a* and 14*b* which are common electrodes not directly generating surface acoustic waves are provided on the outer side of the fluid channel 2 and interdigital electrodes 15*a* and 15*b* directly generating surface acoustic waves can be formed on the overall fluid channel 2, whereby the driving force for the fluid can be advantageously be increased.

The portion where the interdigital electrodes 15*a* and 15*b* mesh with each other is preferably inside the fluid channel 2, as described with reference to FIG. 7.

The propagation direction of a piezoelectric substrate for surface acoustic waves and the direction of the fluid channel 2 provided with a surface acoustic wave generating portion 102 are preferably matched each other, also as described above.

This fluid actuator can drive the fluid in a desired direction as hereinabove described, while the same must be capable of switching the flow of the fluid in an analysis device or the like.

Figure 17:
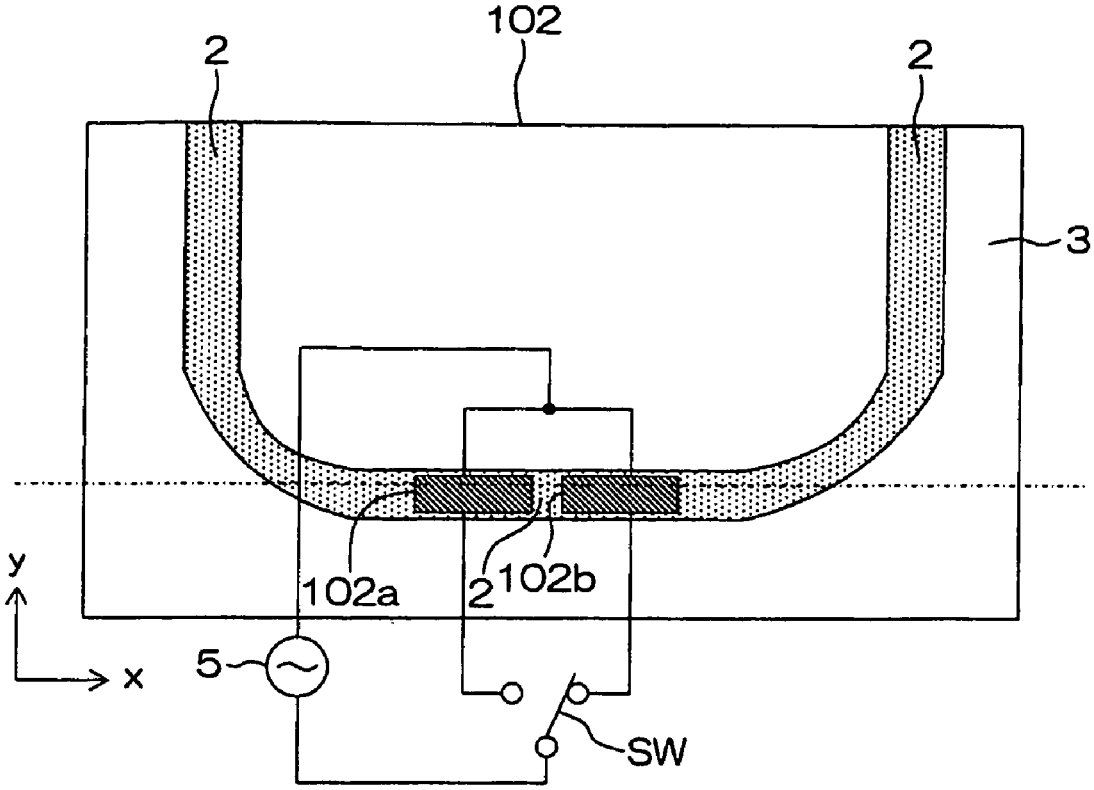
FIG. 17(*a*) A plan view schematically showing an example of an arrangement of two surface acoustic wave generating portions in the fluid channel.
Figure 17:
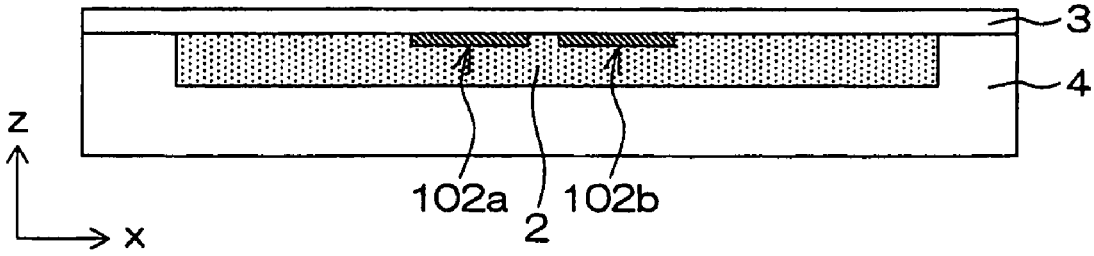

In this case, two surface acoustic wave generating portions may be provided, as shown in FIGS. 17(*a*) and 17(*b*). In the case of FIGS. 17(*a*) and 17(*b*), surface acoustic wave generating portions 102*a* and 102*b* are provided separately on a fluid passage 2. Each of the surface acoustic wave generating portions 102*a* and 102*b* includes floating electrodes or a reflector electrode. The propagation direction of surface acoustic waves generated from the surface acoustic wave generating portion 102*a* and the propagation direction of surface acoustic waves generated from the surface acoustic wave generating portion 102*b* are set to be opposite to each other due to the difference between the arrangements of the floating electrodes and the reflector electrode.

Assuming that surface acoustic waves generated from the surface acoustic wave generating portion 102*a* propagate rightward in FIG. 17 and surface acoustic waves generated from the surface acoustic wave generating portion 102*b* propagate leftward in FIG. 17, for example, the fluid actuator may supply an AC voltage to only the left surface acoustic wave generating portion 102*a* through a switch SW in order to rightwardly drive the fluid, and may supply the AC voltage to only the right surface acoustic wave generating portion 102*b* through the switch SW in order to leftwardly drive the fluid.

As a structure extracting electrodes from the substrate 3, a structure obtained by replacing the surface acoustic wave generating portion 101 described with reference to FIGS. 9(*a*) and 9(*b*) with the surface acoustic wave generating portion 102 according to this embodiment, to attain absolutely the same effects.

Figure 18:
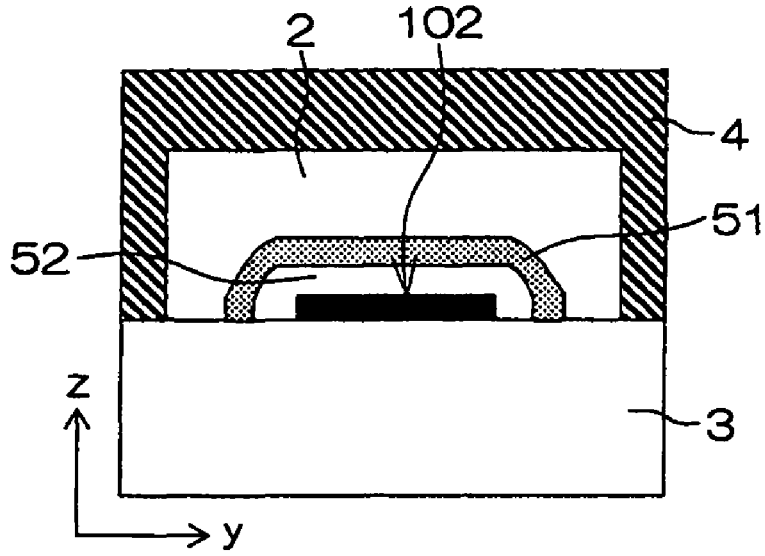
FIG. 18(*a*) A front sectional view schematically showing a protective structure covering an interdigital electrode of a fluid actuator.
Figure 18:
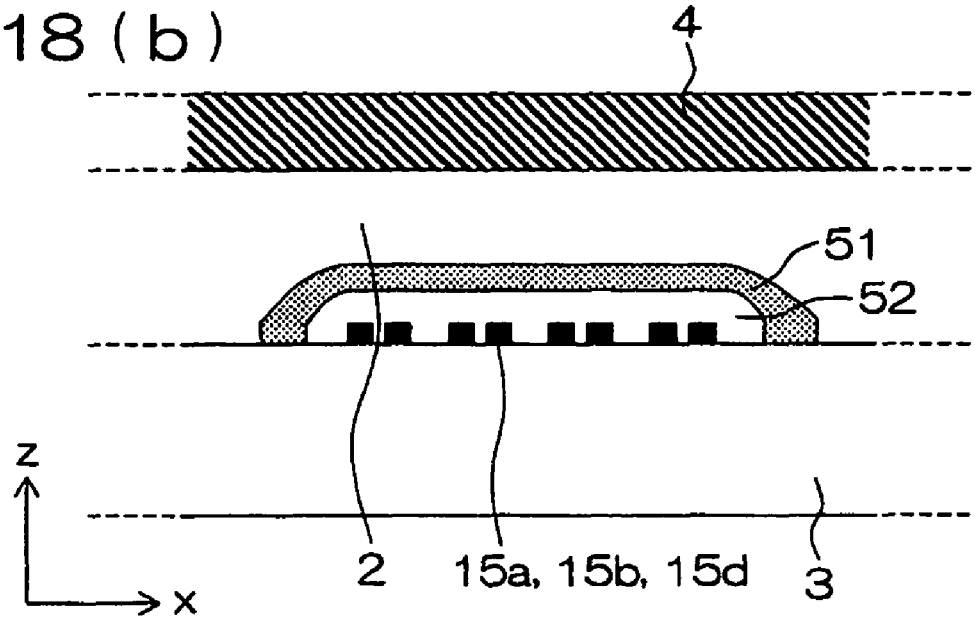

FIGS. 18(*a*) and 18(*b*) illustrate another embodiment of the fluid actuator according to the present invention. A surface acoustic wave generating portion 102 is provided with a protective structure 51 so that a pair of interdigital electrodes 15*a* and 15*b* are not directly in contact with a fluid in a fluid channel 2, and a void 52 is formed between the protective structure and the interdigital electrodes 15*a* and 15*b*. Therefore, vibration of the surface acoustic wave generating portion is not hindered by the fluid, and larger driving force can be obtained.

Figure 19:
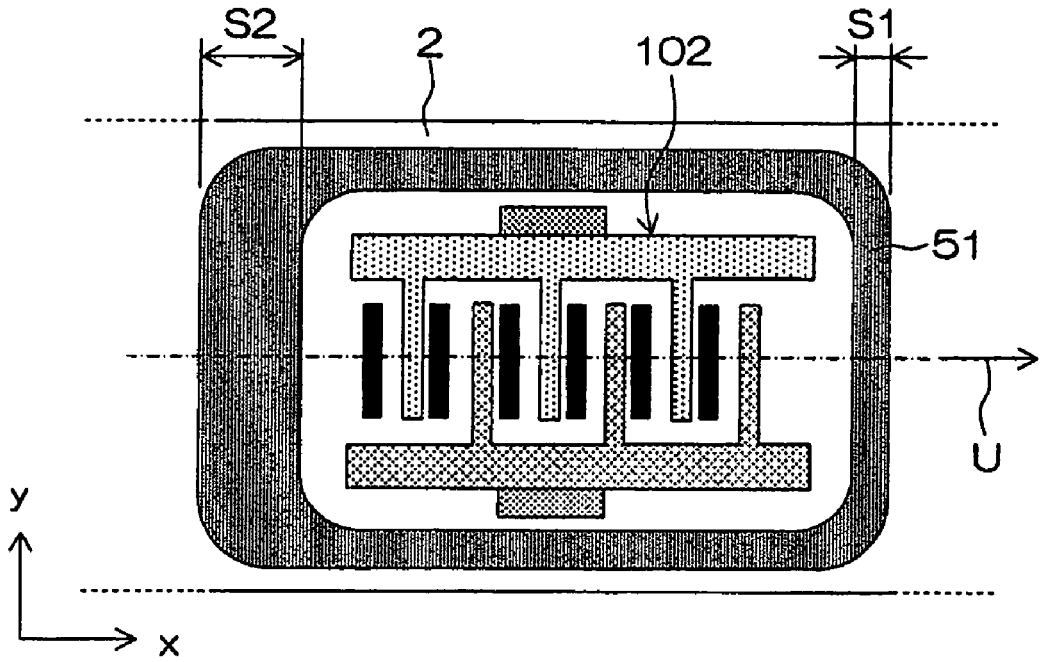
FIG. 19(*a*) A plan sectional view showing such an example that the thickness of a sidewall of the protective structure on the side of a surface acoustic wave propagation direction is smaller than the thickness on the side opposite to this direction.
Figure 19:
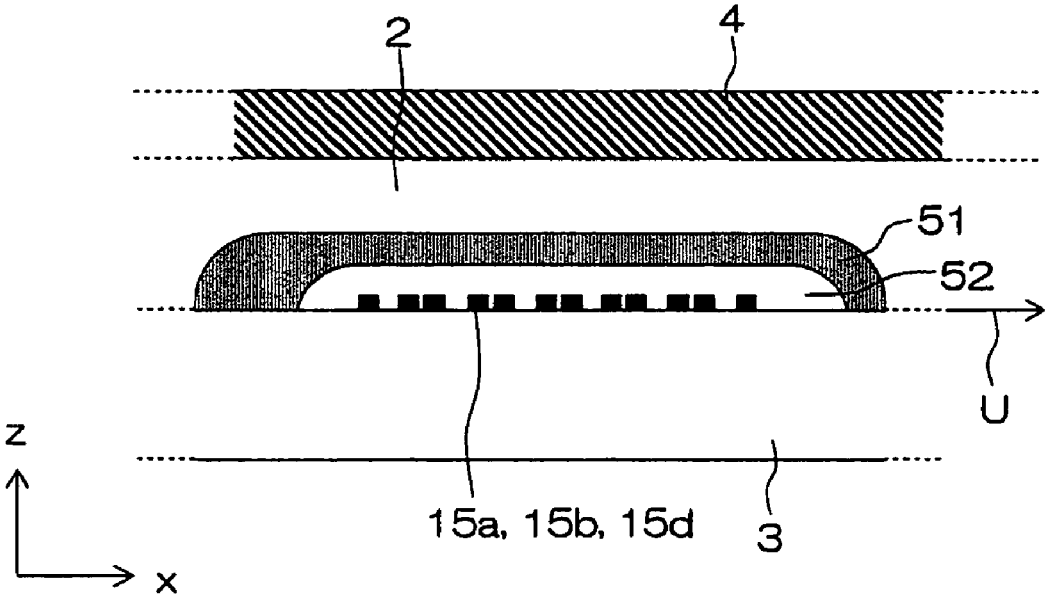

FIGS. 19(*a*) and 19(*b*) illustrate such an example that the thickness of a sidewall of a protective structure 51 on a side of a surface acoustic wave propagation direction is smaller than the thickness on the side opposite to this direction.

Referring to FIGS. 19(*a*) and 19(*b*), the sidewall of the protective structure 51 is so formed that a thickness S1 on the side of the surface acoustic wave propagation direction is smaller as compared with a thickness S2 on the side opposite to this direction. An influence exerted by the protective structure 51 on propagation of the surface acoustic waves showing with an arrow U can be reduced by employing this structure.

A method of manufacturing the aforementioned protective structure 51 is similar to the method described above with reference to FIGS. 10(*a*) and 10(*b*), and hence the description thereof is omitted.

When the inner wall of the fluid channel 2 of the fluid actuator according to this embodiment is vibrated with ultrasonic waves, the fluid in the fluid channel 2 hardly adheres to the wall surface of the fluid channel 2, and passage resistance of the fluid channel 2 can be reduced. This has already been described with reference to FIGS. 11(*a*) to 11(*c*).

FIGS. 20(*a*) and 20(*b*) are a sectional view and a perspective plan view showing an example of still another embodiment of the fluid actuator according to the present invention. FIG. 20(*a*) is a sectional view taken along the line G-G in FIG. 20(*b*).

A U-shaped fluid passage 2 is formed by bonding a lid body 4 and a substrate 3 to each other and a piezoelectric body 31 is fitted into a part of the joint surface of the substrate 3 to face the fluid passage 2, similarly to the above description with reference to FIGS. 2(*a*) and 2(*b*).

The piezoelectric body 31 may not be fitted into the part of the substrate 3, but the piezoelectric body 31 may be attached to the overall substrate 3, or the substrate 3 itself may be formed by the piezoelectric body 31, also similarly to the above description with reference to FIGS. 3(*a*) and 3(*b*).

Figure 21:
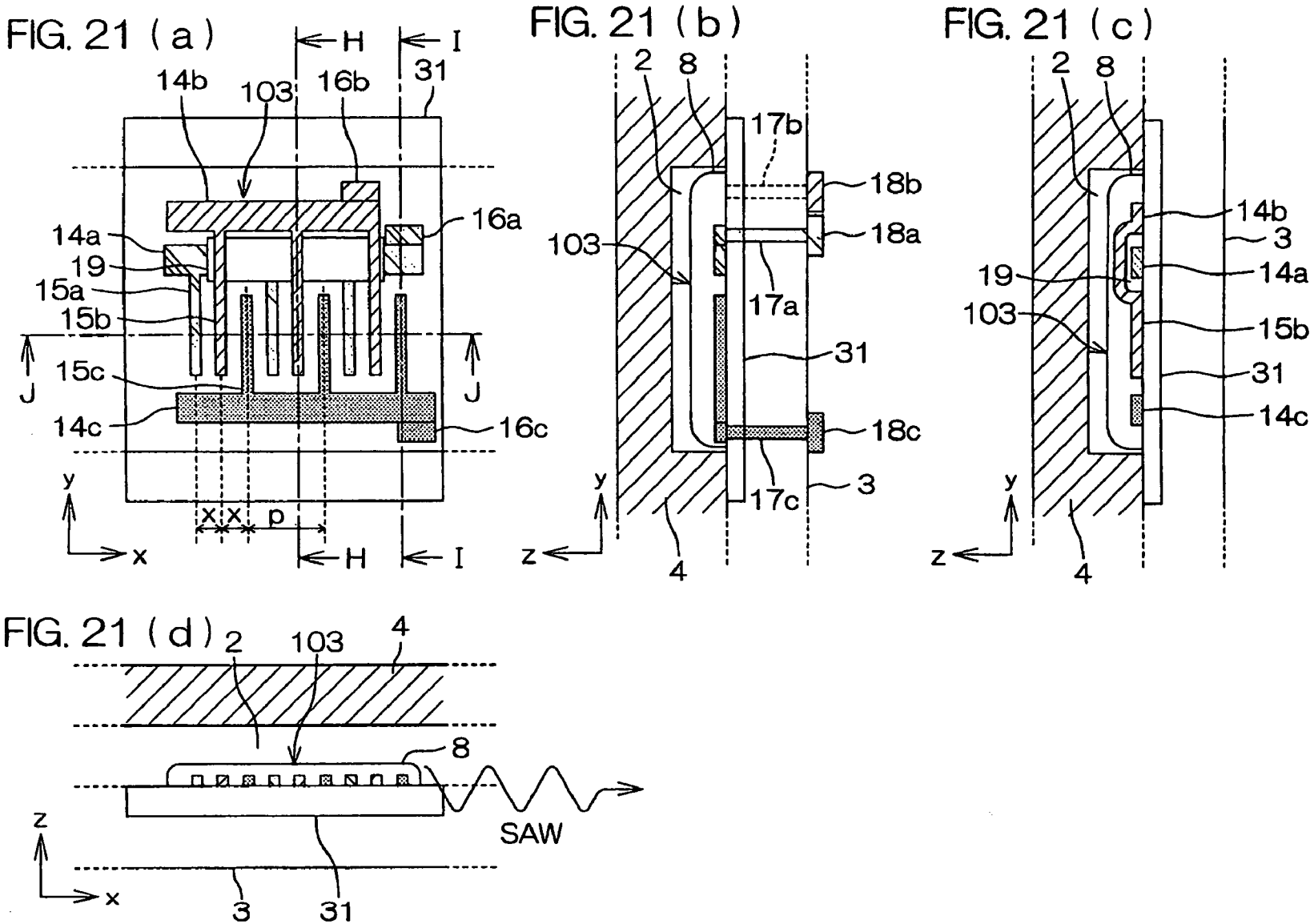
FIG. 21(*a*) An enlarged plan view schematically showing the structure of the fluid actuator around a surface acoustic wave generating portion.

FIGS. 21(*a*) to 21(*d*) are enlarged views schematically showing the structure of an example of a surface acoustic wave generating portion 103 related to the fluid actuator according to this embodiment, FIG. 21(*a*) is a plan view of a piezoelectric substrate, and FIGS. 21(*b*), 21(*c*) and 21(*d*) are sectional views taken along the lines I-I, J-J and H-H respectively.

Three types of interdigital electrodes 15*a*, 15*b* and 15*c* are formed on a piezoelectric body 31 constituting a part of the wall surface of a fluid channel 2 in mesh with one another, as shown in FIG. 21(*a*). The portion where the interdigital electrodes 15*a*, 15*b* and 15*c* are formed on this piezoelectric body 31 is referred to as the surface acoustic wave generating portion 103.

The interdigital electrode 15*a* is arranged at a pitch p. The interdigital electrode 15*b* is also arranged at the same pitch p. The interdigital electrode 15*c* is also arranged at the same pitch p. The intervals between the interdigital electrodes 15*a* and 15*b*, between the interdigital electrodes 15*b* and 15*c* and between the interdigital electrodes 15*c* and 15*a* are identical to one another. Assuming that x represents these intervals, the relation $x=p/3$ is established. When the phase of one pitch p is expressed as 360°, therefore, the interdigital electrodes 15*a*, 15*b* and 15*c* are arranged 120° out of phase with one another.

The shift x between the electrode fingers may not be strictly 120°. The difference ratio between the shift x between the electrode fingers and 120° may simply be set in a predetermined range. The "predetermined range" may be experimentally decided with reference to whether or not the fluid flows in a predetermined direction.

Numeral 8 denotes an insulating film covering the interdigital electrodes 15*a*, 15*b* and 15*c* provided on the piezoelectric substrate 31.

Common electrodes (bus-bar electrodes) 14*a* and 14*b* are formed in parallel with each other on a position of the piezoelectric body 31 close to one wall of the fluid channel 2, and the interdigital electrodes 15*a* and 15*b* are formed to perpendicularly extend from the respective bus-bar electrodes 14*a* and 14*b*. An insulating layer 19 is interposed between the bus-bar electrode 14*a* and the interdigital electrode 15*b* so that the electrodes do not short-circuit to each other. A bus-bar electrode 14*c* is formed on a position of the piezoelectric body 31 closer to another wall of the fluid channel 2, and the interdigital electrode 15*c* is formed to perpendicularly extend from the bus-bar electrode 14*c*.

A via electrode connecting portion 16*a* is formed on the outer side of the bus-bar electrode 14*a*, a via electrode connecting portion 16*b* is formed on the outer side of the bus-bar electrode 14*b*, and a via electrode connecting portion 16*c* is formed on the outer side of the bus-bar electrode 14*c*.

The via electrode connecting portion 16*a* is connected to an external electrode 18*a* formed on the back surface of a substrate 3 through a via electrode 17*a* passing through the piezoelectric body 31 and the substrate 3, as shown in FIG. 21(*b*). The via electrode connecting portion 16*b* is connected to an external electrode 18*b* formed on the back surface of the substrate 3 through a via electrode 17*b* passing through the piezoelectric body 31 and the substrate 3. The via electrode connecting portion 16*c* is connected to an external electrode 18*c* formed on the back surface of the substrate 3 through a via electrode 17*c* passing through the piezoelectric body 31 and the substrate 3.

AC voltages sequentially out of phase with one another are supplied from an AC power source 5 to the external electrodes 18*a*, 18*b* and 18*c*. Thus, the AC voltages sequentially out of phase with one another are applied to the respective interdigital electrodes 15*a*, 15*b* and 15*c*.

Assuming that V (volts) represents the amplitude of an AC voltage, f (1/sec.) represents a frequency and t (seconds) represents a time, AC voltages expressed in numerical formulas $V\sin(2\pi ft)$, $V\sin(2\pi ft-2\pi/3)$ and $V\sin(2\pi ft-4\pi/3)$ are applied to the interdigital electrodes 15*a*, 15*b* and 15*c* respectively. Thus, progressive waves of surface acoustic waves having displacement components in directions x and z propagate in the direction x from the surface acoustic wave generating portion 103 along the wall surface of the fluid channel 2 (the joint surface of the substrate 3).

The phase difference of the AC voltages applied to the external electrodes 18*a*, 18*b* and 18*c* may also not be strictly 120°. The difference between the phase difference of the AC voltages and 120° may be set in a predetermined range. Alternatively, the ratio between the phase difference of the AC voltages and 120° may be set in the predetermined range. The "predetermined range" may be experimentally decided with reference to whether or not the fluid flows in a predetermined direction.

These elastic surface progressive waves drive the fluid in contact with the wall surface of the fluid channel in the progressive direction of the surface acoustic waves.

Assuming that v represents the propagation velocity of the surface acoustic waves, AC voltages of frequencies f satisfying the following formula:

$$v=fp$$

are desirably applied to the interdigital electrodes 15*a*, 15*b* and 15*c* so that the structural period p of the interdigital electrodes 15*a*, 15*b* and 15*c* and the wavelength λ of the generated surface acoustic waves coincide with each other, whereby surface acoustic wave vibration of a large amplitude can be obtained and the driving efficiency for the fluid is improved.

In the aforementioned example, the surface acoustic waves propagating in the direction x are generated by applying the AC voltages $V\sin(2\pi ft)$, $V\sin(2\pi ft-2\pi/3)$ and $V\sin(2\pi ft-4\pi/3)$ to the interdigital electrodes 15*a*, 15*b* and 15*c* respectively. When the order of the phase change is changed to apply AC voltages $V\sin(2\pi ft+2\pi/3)$ and $V\sin(2\pi ft+4\pi/3)$ to the interdigital electrodes 15*b* and 15*c* respectively, surface acoustic waves propagating in the direction −x can be generated.

Thus, the surface acoustic wave generating portion 103 can generate surface acoustic waves of a predetermined direction, for unidirectionally driving the fluid in the fluid channel 2 as a whole.

A further embodiment of the present invention is now described. While the three types of interdigital electrodes 15*a*, 15*b* and 15*c* are set on the surface acoustic wave generating portion 103 and the three-phase AC voltages are applied thereto in the embodiment shown in FIG. 21, surface acoustic waves propagating in a predetermined direction can be generated when employing two types of interdigital electrodes 15*a* and 15*b* and a ground electrode and applying single-phase AC voltages out of phase with each other respectively.

Figure 22:
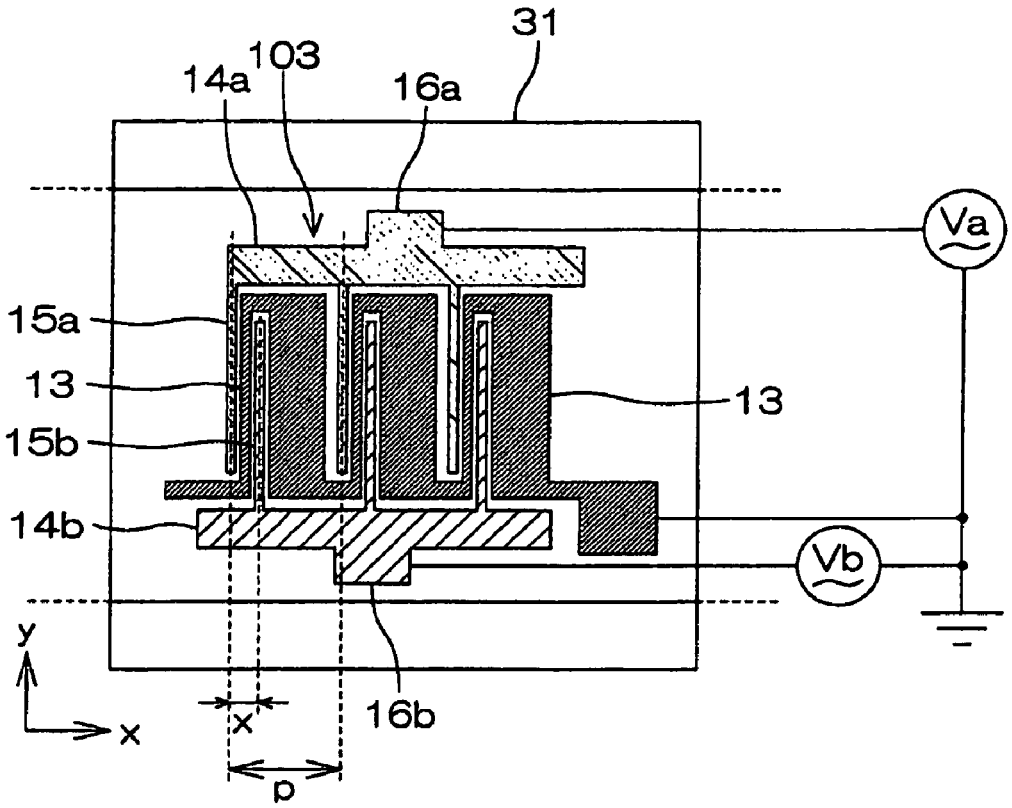
FIG. 22 An enlarged plan view showing a further structure around the surface acoustic wave generating portion.

FIG. 22 is an enlarged view showing a surface acoustic wave generating portion 103 including two types of interdigital electrodes arranged with electrode fingers thereof meshed with one another and a ground electrode arranged between adjacent electrode fingers.

A pair of interdigital electrodes 15*a* and 15*b* are formed on a piezoelectric body 31, and a ground electrode 13 is further formed between the interdigital electrodes 15*a* and 15*b* in parallel with the interdigital electrodes 15*a* and 15*b*. Therefore, the ground electrode 13 intervenes between the interdigital electrodes 15*a* and 15*b*.

In this structure, the interdigital electrode 15*a* is arranged at a pitch p, and the interdigital electrode 15*b* is also arranged at the same pitch p. Assuming that x represents the interval between the interdigital electrodes 15*a* and 15*b*, the relation $x=p/4$ is established. In other words, the centers of the electrode fingers of the pair of interdigital electrodes 15*a* and 15*b* in mesh with one another are arranged with shift of 90°.

Figure 23:
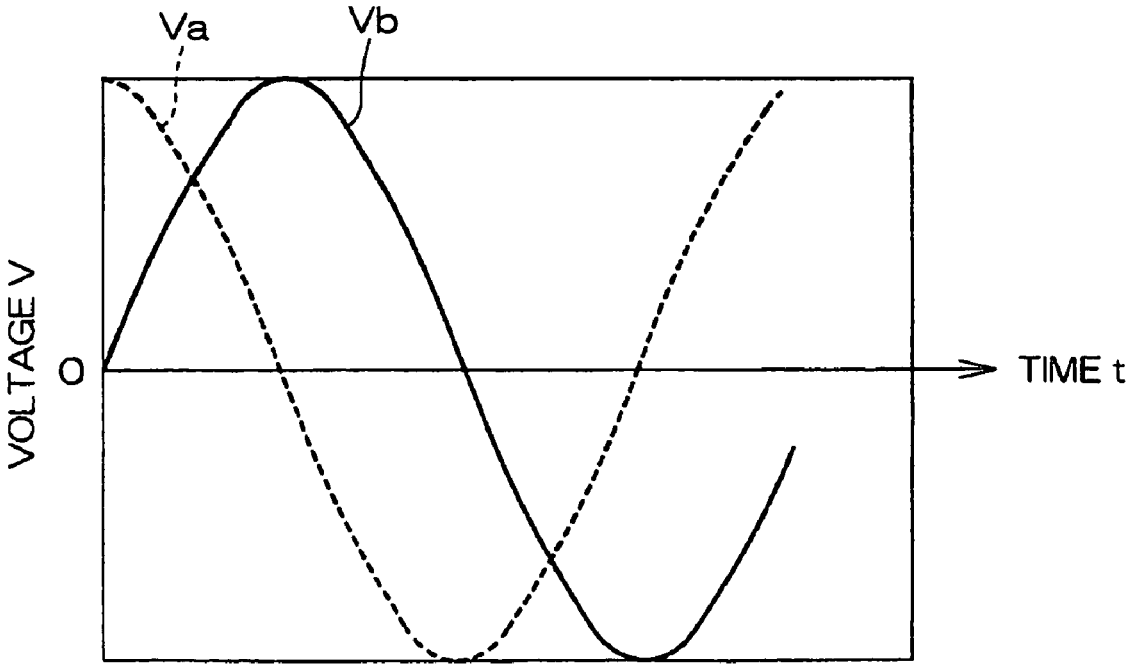
FIG. 23 A graph showing the waveforms of two-phase voltages applied to the interdigital electrode.

FIG. 23 shows the waveforms of voltages Va and Vb applied to the interdigital electrodes 15*a* and 15*b*. The voltages Va and Vb are out of phase with each other by 90°, coincidentally with the shift between the interdigital electrodes 15*a* and 15*b*.

Assuming that V (volts) represents the amplitude of an AC voltage, f (1/sec.) represents a frequency and t (seconds) represents a time, AC voltages expressed in numerical formulas $V\sin(2\pi ft)$ and $V\sin(2\pi ft-\pi/2)$ are applied to the interdigital electrodes 15*a* and 15*b* respectively. Thus, progressive waves of surface acoustic waves having displacement components of directions x and z propagate in the direction x from the surface acoustic wave generating portion 103 along the wall surface of a fluid channel 2 (the joint surface of a substrate 3).

When the order of the phase change is changed to apply AC voltages $V\sin(2\pi ft)$ and $V\sin(2\pi ft+\pi/2)$ to the interdigital electrodes 15*a* and 15*b*, surface acoustic waves propagating in the direction −x can be generated.

Thus, the shift in the spatial arrangement of the interdigital electrodes 15*a* and 15*b* and the phase shift of the applied voltages Va and Vb correspond to each other. Therefore, surface acoustic waves can be propagated in a predetermined direction from the surface acoustic wave generating portion 103 along the wall surface of the fluid channel 2 by applying the AC voltages Va and Vb to the interdigital electrodes 15*a* and 15*b*.

While the phase shift of the applied AC voltages and the shift between the centers of the electrode fingers desirably coincide with each other, the same may not strictly coincide with each other but the difference or the ratio therebetween may be set in a predetermined range. The "predetermined range" may be experimentally decided with reference to whether or not the fluid flows in a predetermined direction.

The positional shift between the centers of the electrode fingers in mesh with one another is not restricted to 90°, but may be 120° or still another phase difference (excluding 180°, in order to avoid a spatially symmetrical arrangement).

The fluid actuator according to the present invention is not restricted to the aforementioned structure. For example, bus-bar electrodes 14*a*, 14*b* and 14*c* may be formed outside a fluid channel 2, as shown in FIG. 24. Thus, the bus-bar electrodes 14*a* and 14*b* which are common electrodes not directly generating surface acoustic waves are provided outside the fluid channel 2 and interdigital electrodes 15*a* and 15*b* directly generating surface acoustic waves can be formed on the overall fluid channel 2, whereby the driving force for the fluid can be advantageously increased.

The portion where the interdigital electrodes 15*a*, 15*b* and 15*c* mesh with one another is preferably inside the fluid channel 2. If the junction between the piezoelectric substrate 31 and the lid body 4 is present on the portion where the interdigital electrodes 15*a*, 15*b* and 15*c* mesh with one another, this junction may inhibit vibration of surface acoustic waves, and the junction may be damaged or come off due to vibration of the surface acoustic waves. This has already been described with reference to FIG. 7.

The propagation direction of the piezoelectric substrate for the surface acoustic waves and the direction of the fluid channel 2 provided with the surface acoustic wave generating portion 103 are preferably matched to each other, also as described above.

FIGS. 25(*a*) and 25(*b*) illustrate another example of a structure for extracting electrodes from a surface acoustic wave generating portion 103 to the exterior of a substrate 3.

In a fluid actuator shown in FIGS. 25(*a*) and 25(*b*), extraction electrodes 20*a*, 20*b* and 20*c* extending from interdigital electrodes 15*a*, 15*b* and 15*c* toward the side end surface of the substrate 3 are formed on the substrate 3.

In order to manufacture this fluid actuator, the extraction electrodes 20*a*, 20*b* and 20*c* extending from the interdigital electrodes 15*a*, 15*b* and 15*c* toward the side end surface of the substrate 3 are simultaneously formed on the substrate 3 in the step of preparing the interdigital electrodes 15*a*, 15*b* and 15*c*. Thereafter side electrodes 18*a*, 18*b* and 18*c* linked with the extraction electrodes 20*a*, 20*b* and 20*c* are formed on the side end surface of the substrate 3. A lid body 4 provided with a fluid channel 2 and the substrate 3 are bonded to each other through PDMS (poly dimethylsiloxane), which is a kind of silicone rubber, for example, and the fluid channel 2 is airtightly sealed, for completing the fluid actuator.

In this example shown in FIGS. 25(*a*) and 25(*b*), no via hole (through-hole) passing through the piezoelectric body 31 may be provided in the substrate 3, dissimilarly to FIG. 21(*b*). While the piezoelectric body 31 may be cracked or broken when provided with the through-hole, no through-hole may be provided when the structure shown in FIG. 25 is employed, whereby the piezoelectric body 31 can be prevented from cracking or breakage.

Also in the fluid actuator according to the present invention, a protective structure is preferably provided on the surface acoustic wave generating portion 103 through a void between the same and the interdigital electrodes so that the interdigital electrodes 15*a*, 15*b* and 15*c* are not directly in contact with the fluid in the fluid channel 2, as described with reference to FIGS. 9 and 18. Thus, vibration of the surface acoustic wave generating portion is not hindered by the fluid, and larger driving force can be obtained. Further, the thickness of the sidewall of the protective structure on the side closer the surface acoustic wave propagation direction is preferably made smaller as compared with the thickness on the side opposite to this direction, as described with reference to FIG. 19. This is because an influence exerted by the protective structure on propagation of the surface acoustic waves can be reduced.

When the inner wall of the fluid channel 2 of the fluid actuator according to this embodiment is vibrated with ultrasonic waves, the fluid in the fluid channel 2 hardly adheres to the wall surface of the fluid channel 2, and passage resistance of the fluid channel 2 can be reduced. This has already been described with reference to FIGS. 11(*a*) to 11(*c*).

APPLICATION EXAMPLES

FIGS. 26(*a*) and 26(*b*) are a plan view and a sectional view taken along the line Q-Q showing an example of applying the fluid actuator according to the present invention to a device generating heat (hereinafter generically referred to as "heat generating device") such as an integrated circuit, an external storage device, a light-emitting device or a cold-cathode tube.

Referring to FIGS. 26(*a*) and 26(*b*), a part of a semiconductor substrate is employed as a lid body 4 of the fluid actuator. An SOI (Silicon on Insulator) substrate having an $SiO_2$ sandwiched between silicon layers as an insulating layer, for example, is employed as the semiconductor substrate.

A semiconductor circuit 32 is formed on a lower silicon layer 23 of the semiconductor substrate. An upper silicon layer 25 on an insulating layer 24 is etched by ICP-RIE through a mask of an aluminum film as described above, for forming a meandering fluid channel 2. The side of the semiconductor substrate provided with the fluid channel 2 is bonded to a substrate 3 mounted with surface acoustic wave generating portions 101*a* and 101*b*.

A container 6 storing a fluid is connected to both ends 26 and 27 of the fluid channel 2 through pipes. The fluid in the container 6 circulates through the pipes and the fluid channel 2 and returns to the container 6. A heat exchanger 28 such as a radiation fin is provided on an intermediate position of this circulation, and heat generated in the semiconductor circuit can be released to the exterior through this heat exchanger 28.

A mixture of 72% of pure water, 24% of propylene glycol and 4% of a metal preservative or the like, a mixture of 75% of pure water and 25% of ethylene glycol, or light reformate can be employed as a cooling fluid.

The surface acoustic wave generating portions 101*a* and 101*b* according to the present invention are arranged on two positions of the fluid channel 2 of the substrate 3 respectively. The number of the surface acoustic wave generating portions is not restricted to two, but may alternatively be one or not less than three.

In this structure shown in FIGS. 26(*a*) and 26(*b*), attention is drawn to the surface acoustic wave generating portion 101*a*. A virtual line M1 passing a generally central portion of the surface acoustic wave generating portion 101 is drawn toward propagation directions of surface acoustic waves, i.e., directions x and −x, and it is assumed that C denotes the intersection between the line extending from a first end A of the surface acoustic wave generating portion 101 and the wall surface of the fluid channel 2, and that D denotes the intersection between the line extending from a second end B of the surface acoustic wave generating portion 101 and the end 26 of the fluid channel 2.

In this structure, a distance $d_3$ between A and C and a distance $d_4$ between B and D satisfy the relation $d_3<d_4$. Therefore, the surface acoustic wave generating portion 101*a* can leftwardly and rightwardly unbalance driving force supplied to portions of the fluid located on both sides of this surface acoustic wave generating portion 101*a* in cooperation with the fluid channel 2, and can unidirectionally drive the fluid in the fluid channel 2 as a whole.

The surface acoustic wave generating portion 101*b* can also unidirectionally drive the fluid in the fluid channel 2 through an arrangement similar to that of the surface acoustic wave generating portion 101*a*. Thus, the fluid can be driven through both of the surface acoustic wave generating portions 101*a* and 101*b*, whereby the force for driving the fluid can be increased.

FIGS. 27(*a*) and 27(*b*) are a plan view and a sectional view taken along the line R-R showing an embodiment of an analysis device utilizing the fluid actuator according to the present invention.

FIG. 27(*a*) is a plan view showing a lid body 4 of an analysis device 40 according to the present invention, and a generally cross-shaped groove is formed in the lid body 4. This lid body 4 is bonded to a substrate 3, thereby forming a horizontal fluid channel 2*a* and a vertical fluid channel 2*b*.

In the state where the lid body 4 is bonded to the substrate 3, both ends of the horizontal fluid channel 2*a* communicate with fluid channels 2*c* and 2*d* provided on the substrate 3, and both ends of the vertical fluid channel 2*b* communicate with fluid channels 2*e* and 2*f* provided on the substrate 3.

Surface acoustic wave generating portions 101*c* and 101*d* are arranged on positions of the substrate 3 corresponding to the fluid channels 2*a* and 2*b* respectively. Either one of the surface acoustic wave generating portions 101*c* and 101*d* is driven by a switch (not illustrated but equivalent to that in FIG. 8). Numeral 43 denotes a measuring section for measuring a sample fluid. While the measurement principle of the measuring section is not restricted, the measuring section analyzes the sample fluid by measuring a light absorption spectrum, for example.

A sample fluid S is introduced into the fluid channels 2*c*, 2*a* and 2*d*, while a carrier fluid for carrying the sample fluid S to a measuring point of the measuring section 43 is introduced into the fluid channels 2*e*, 2*b* and 2*f*.

Blood, a sample solution containing a cell or DNA or a buffer solution can be employed as the sample fluid S.

When the surface acoustic wave generating portion 101*c* is driven, the sample fluid S is driven through the fluid channels 2*c*, 2*a* and 2*d*, as shown in FIG. 28(*a*).

When the switch is changed over in this state to drive the surface acoustic wave generating portion 101*d*, the carrier fluid is driven through the fluid channels 2*e*, 2*b* and 2*f*, as shown in FIG. 28(*b*). At this time, the carrier fluid can transport the sample fluid S present on the coupling portion of the cross-shaped groove through the fluid channel 2*b* for carrying the same to the measuring point of the measuring section 43. Therefore, the sample fluid can be measured with the measuring section 43.

Thus, an arbitrary part of the sample fluid S can be cut out and subjected to measurement, whereby time changes of the characteristics of the sample fluid S or the like can be measured.

FIGS. 29(*a*) and 29(*b*) are a plan view and a sectional view taken along the line T-T showing another example of applying the fluid actuator according to the present invention to a heat generating device.

While the structure shown in FIGS. 29(*a*) and 29(*b*) and that shown in FIGS. 26(*a*) and 26(*b*) are generally identical to each other, the different point resides in that the distance $d_3$ between A and C and the distance $d_4$ between B and D satisfy the relation $d_3<d_4$ and the surface acoustic wave generating portion 101*a* generates rightwardly and leftwardly unbalanced surface acoustic waves in the structure shown in FIGS. 26(*a*) and 26(*b*), while surface acoustic wave generating portions 102*a* and 102*b* have specific propagation directions of surface acoustic waves respectively in the structure shown in FIGS. 29(*a*) and 29(*b*). In other words, the surface acoustic wave generating portions 102*a* and 102*b* may be arranged on arbitrary positions in a fluid channel 2, so far as the same do not hinder measurement.

The propagation directions are set to a direction −x, for example, as to the surface acoustic wave generating portions 102*a* and 102*b* respectively. Therefore, a fluid in the fluid channel 2 can be unidirectionally driven as a whole by generating leftward surface acoustic waves from the surface acoustic wave generating portions 102*a* and 102*b*.

While the surface acoustic wave generating portions 102*a* and 102*b* are employed in the example shown in FIGS. 29(*a*) and 29(*b*), surface acoustic wave generating portions 103*a* and 103*b* can also be employed in place of the surface acoustic wave generating portions 102*a* and 102*b*.

Further, the fluid actuator according to this embodiment can also be utilized for the analysis device shown in FIGS. 27(*a*) and 27(*b*).

In this case, surface acoustic wave generating portions 102*c* and 102*d* or 103*c* and 103*d* having specific propagation directions are used in place of the surface acoustic wave generating portions 101*c* and 101*d*. The surface acoustic wave generating portions 102*c* and 102*d* or 103*c* and 103*d* have specific propagation directions, whereby the same may advantageously be arranged on arbitrary positions in the fluid passage 2, so far as the same do not hinder measurement.

Examples

As to the fluid actuator according to the present invention, a manufacturing method therefor is described with reference to the structure shown in FIGS. 2(*a*) and 2(*b*) and 4(*a*) to 4(*c*), unless otherwise stated.

As the substrate 3, the substrate 3 entirely formed by the piezoelectric substrate 31 is employed (see FIG. 3(*b*)). While any substrate may be employed as the piezoelectric substrate 31 so far as the same is a piezoelectric ceramic substrate or a piezoelectric single-crystalline substrate having piezoelectricity, a single-crystalline substrate of lead zirconate titanate, lithium niobate or potassium niobate having high piezoelectricity is desirably employed so that the driving voltage can be reduced. For example, a single-crystalline 128° Y-rotation X-direction propagation substrate of lithium niobate ($LiNbO_3$) can be employed.

Photoresist (hereinafter abbreviated as resist) is applied onto the piezoelectric substrate 31 by spin coating, for example. Then, photolithography is performed with a photomask, for forming a resist pattern having opening portions for forming the interdigital electrodes 15*a* and 15*b*, the bus-bar electrodes 14*a* and 14*b* and the via electrode connecting portions 16*a* and 16*b*.

When floating electrodes are provided as shown in FIG. 13(*a*), a pattern of the floating electrodes 15*d* is also formed. When performing driving with three-phase voltages as shown in FIG. 21(*a*), patterns of the interdigital electrode 15*c*, the bus-bar electrode 14*c* and the via electrode connecting portion 16*c* are also formed.

Further, an electrode material is deposited on the entire surface of the piezoelectric substrate 31 by resistance heating vacuum evaporation, and the electrode material is removed from portions other than the electrodes by lift-off. While the electrode material is prepared by depositing gold of about 5000 Å in thickness on chromium of about 500 Å in thickness, aluminum, nickel, silver, copper, titanium, platinum, palladium or a further conductive material may alternatively be employed.

In order to deposit the electrode material, electron-beam evaporation or sputtering may be employed in place of the resistance heating vacuum evaporation. In place of the aforementioned lift-off step, the electrodes may be prepared by applying resist after depositing the electrode material on the substrate 3, forming a resist pattern having openings in portions other than electrode portions by photolithography, and etching the electrode material.

As to the shape of the interdigital electrodes 15*a* and 15*b* shown in FIG. 4(*a*), the electrode width is 20 μm, the structural period p is 80 μm and the number of electrode pairs is 40, while the length L of the surface acoustic wave generating portion 101 is 3.2 mm, and the length K of the intersection between the interdigital electrodes 15*a* and 15*b* is 2 mm. The width of the bus-bar electrodes 14*a* and 14*b* is 300 μm, and the via electrode connecting portions 16*a* and 16*b* are 500 μm by 500 μm.

As to the shape of the interdigital electrodes 15*a* and 15*b* shown in FIG. 13(*a*), the electrode width is 10 μm, the structural period p is 80 μm and the number of electrode pairs is 40, while the length L of the surface acoustic wave generating portion 102 is 3.2 mm, and the length K of the intersection between the interdigital electrodes 15*a* and 15*b* is 2 mm. As to the shape of the floating electrodes 15*d*, the electrode width is 10 μm, and the length is 2 mm. The offset $x_0$ of the floating electrodes 15*d* is 20 μm, for example. The width of the bus-bar electrodes 14*a* and 14*b* is 300 μm, and the via electrode connecting portions 16*a* and 16*b* are 500 μm by 500 μm.

As to the shape of the interdigital electrodes 15*a*, 15*b*, 15*c* shown in FIG. 21(*a*), the electrode width is 10 μm, the structural period p is 80 μm and the number of electrode pairs is 40, while the length L of the surface acoustic wave generating portion 103 is 3.2 mm, and the length K of the intersection between the interdigital electrodes 15*a*, 15*b* and 15*c* is 2 mm. The width of the bus-bar electrodes 14*a*, 14*b* and 14*c* is 300 μm, and the size of the via electrode connecting portions 16*a*, 16*b* and 16*c* is 500 μm by 500 μm.

Then, a through-hole having a diameter of 100 μm is formed in the substrate 3 by sandblasting, for example, and the electrode material is filled into the through-hole by plating, for example. The through-hole may alternatively be formed by a femtosecond laser. Nickel, copper or other conductive material is employed as the electrode material. The external electrodes 18*a* and 18*b* are formed on the back surface of the substrate 3 through a preparation step similar to that for the interdigital electrodes 15*a* and 15*b* or by screen printing.

Then, an $SiO_2$ film is formed on the electrodes of the surface acoustic wave generating portion 101 as the insulating film 8 by CVD (chemical vapor deposition (CVD)) employing TEOS (tetramethoxy germanium), for example.

A silicon substrate, for example, is employed as the lid body 4. An aluminum film is deposited on the silicon substrate by a thickness of 1 μm by vapor deposition or sputtering, and a resist pattern is prepared by photolithography so that a potion corresponding to the fluid channel 2 is open.

Then, the portion of the aluminum film corresponding to the fluid channel 2 is opened with an aluminum etching solution (example: SEA-G by Sasaki Chemical Co., Ltd.) and anisotropic etching is performed by repeating etching with $SF_6$ gas and protective film preparation with $C_4F_8$ in an ICP-RIE (inductively coupled plasma reactive ion etching) device through a mask of this aluminum film, thereby forming the fluid channel 2 having a width of 4 mm and a depth of 500 μm. The aluminum film employed as the mask is removed by acid treatment or the like.

The lid body 4 may be prepared from any material such as quartz, plastic, rubber, metal, ceramic or the like, in place of silicon. For example, the aforementioned PDMS may be employed. The fluid channel 2 may also be formed by wet etching with KOH or the like, or may be prepared by a mold, by machining or by molding. The sectional shape of the fluid channel 2 is also not restricted to the rectangular shape shown in FIGS. 2(*a*) and 2(*b*), but may be semicircular or triangular.

Finally, the substrate 3 and the lid body 4 are bonded to each other through PDMS, for example, for completing the fluid actuator.

The invention claimed is:

1. A fluid actuator comprising:

a piezoelectric body;

a fluid channel having the piezoelectric body on a part of an inner wall thereof and capable of moving a fluid therein; and a surface acoustic wave generating portion driving the fluid in the fluid channel with surface acoustic waves generated from interdigital electrodes formed on a surface of the piezoelectric body facing the fluid channel, wherein the fluid channel comprises a first channel that is positioned on one side of the surface acoustic wave generating portion and a second channel that is positioned on another side of the surface acoustic wave generating portion, and wherein the surface acoustic wave generating portion moves the fluid in a direction from the second channel to the first channel by applying a stronger driving force to the fluid in the first channel than to the fluid in the second channel.

2. The fluid actuator according to claim 1, wherein assuming that C and D denote two points where a straight line extended along both propagation directions of the surface acoustic waves generated from the surface acoustic wave generating portion collides with the wall surfaces of the fluid channel or ports of the fluid channel respectively, the surface acoustic wave generating portion is arranged on a position shifted from a central position between the points C and D along either propagation direction of the surface acoustic waves.

3. The fluid actuator according to claim 2, wherein a distance $d_1$ between one end A of the surface acoustic wave generating portion and the wall surface C of the fluid channel and a distance $d_2$ between the other end B of the surface acoustic wave generating portion and the wall surface D of the fluid channel are in such a relation that one is larger and the other is smaller.

4. The fluid actuator according to claim 3, wherein the smaller distance is not more than 20 mm.

5. The fluid actuator according to claim 2, wherein the wall surface of the fluid channel closer to the surface acoustic wave generating portion is a plane generally orthogonal to the propagation directions of the surface acoustic waves.

6. The fluid actuator according to claim 1, wherein the surface acoustic wave generating portion generates surface acoustic waves having directivity in the single direction.

7. The fluid actuator according to claim 6, wherein the surface acoustic wave generating portion comprises between adjacent electrode fingers of the interdigital electrodes a floating electrode arranged parallelly to these electrode fingers on a position offset from a center between these electrode fingers toward a direction of either electrode finger.

8. The fluid actuator according to claim 6, wherein the surface acoustic wave generating portion comprises a reflector electrode arranged adjacently to one side of the interdigital electrodes for reflecting the surface acoustic waves generated in and propagating from the interdigital electrodes in the opposite direction.

9. The fluid actuator according to claim 6, wherein the surface acoustic wave generating portion has at least three types of interdigital electrodes respectively provided with constant-pitch electrode fingers arranged in mesh with one another, and AC voltages sequentially out of phase with one another are applied to the at least three types of interdigital electrodes, thereby generating the surface acoustic waves having directivity in the single direction.

10. The fluid actuator according to claim 6, wherein the surface acoustic wave generating portion has two types of interdigital electrodes respectively provided with constant-pitch electrode fingers arranged in mesh with one another, and a ground electrode arranged between adjacent electrode fingers of the interdigital electrodes, the adjacent electrode fingers are arranged at an interval smaller than or larger than half one pitch, and two AC voltages having a phase difference corresponding to the interval between the adjacent electrode fingers are applied to the respective interdigital electrodes, thereby generating the surface acoustic waves having directivity in the single direction.

11. The fluid actuator according to claim 1, further comprising a substrate constituting another part of the inner wall of the fluid channel, wherein the piezoelectric body is fitted into a part of the substrate.

12. The fluid actuator according to claim 1, wherein a common electrode connected with ends of electrode fingers forming the interdigital electrodes is arranged outside the fluid channel.

13. The fluid actuator according to claim 1, wherein not less than two surface acoustic wave generating portions are provided along the fluid channel, and either surface acoustic wave generating portion is selectively driven.

14. The fluid actuator according to claim 2, wherein two surface acoustic wave generating portions are provided, the two surface acoustic wave generating portions are arranged on positions shifted from the central position of the fluid channel sandwiched between the points C and D along both propagation directions of the surface acoustic waves respectively, and either surface acoustic wave generating portion is selectively driven.

15. The fluid actuator according to claim 1, wherein the piezoelectric body is provided with a protective structure covering the interdigital electrodes for preventing contact with the fluid, and a gap is formed between the protective structure and the interdigital electrodes.

16. The fluid actuator according to claim 15, wherein the protective structure comprises a sidewall enclosing the gap, and a thickness of the sidewall on the side of the predetermined direction to which the surface acoustic waves from the surface acoustic wave generating portion propagate is smaller than a thickness on the side opposite to this predetermined direction.

17. The fluid actuator according to claim 1, further comprising a vibration application means vibrating the inner wall of the fluid channel with ultrasonic waves.

18. The fluid actuator according to claim 1, wherein the fluid channel is capable of circulating the fluid.

19. A fluid actuator comprising:

a piezoelectric body;

a fluid channel having the piezoelectric body on a part of an inner wall thereof and capable of moving a fluid therein; and a surface acoustic wave generating portion driving the fluid in the fluid channel with surface acoustic waves generated from interdigital electrodes formed on a surface of the piezoelectric body facing the fluid channel, wherein a surface of the inner wall on which the piezoelectric body is placed has a substantially same coefficient of elasticity as that of the piezoelectric body so that the propagation velocity of the surface acoustic wave and the propagation velocity on the piezoelectric body generally coincide with each other, and wherein the surface acoustic wave generating portion comprises between adjacent electrode fingers of the interdigital electrode a floating electrode arranged parallelly to these electrode fingers on a position offset from a center between these electrode fingers toward a direction of either electrode finger.

20. A heat generating device utilizing the fluid actuator according to claim 1 as a cooler, comprising a substrate mounted with this heat generating device, wherein the fluid channel is provided on the substrate.

21. An analysis device comprising the fluid actuator according to claim 1, provided with a sample supply section supplying a fluidic sample and a sample analysis section analyzing the sample, wherein the fluid channel is so provided as to transport the fluidic sample from the sample supply section to the sample analysis section.

22. The fluid actuator according to claim 1, wherein a material of the inner wall on which the piezoelectric body is placed has a substantially same coefficient of elasticity as that of the piezoelectric body so that the propagation velocity of the surface acoustic wave on the substrate and the propagation velocity on the piezoelectric body generally coincide with each other.

* * * * *

UNITED STATES PATENT AND TRADEMARK OFFICE

CERTIFICATE OF CORRECTION

PATENT NO. : 8,159,110 B2
APPLICATION NO. : 12/096018
DATED : April 17, 2012
INVENTOR(S) : Hirotaka Tsuyoshi et al.

It is certified that error appears in the above-identified patent and that said Letters Patent is hereby corrected as shown below:

Title Page,
Item [75] Inventors, replace "Susumu Suguyama, Kusatsu (JP)" with -- Susumu Sugiyama, Kusatsu (JP) --

Signed and Sealed this
Eleventh Day of October, 2016

Michelle K. Lee

Michelle K. Lee
*Director of the United States Patent and Trademark Office*